US011168492B1

(12) United States Patent
Liang et al.

(10) Patent No.: US 11,168,492 B1
(45) Date of Patent: Nov. 9, 2021

(54) TAMPER RESISTANT SASH LOCK

(71) Applicant: Vision Industries Group, Inc., So. Plainfield, NJ (US)

(72) Inventors: Luke Liang, So. Plainfield, NJ (US); Zhiwen Wei, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 470 days.

(21) Appl. No.: 16/244,212

(22) Filed: Jan. 10, 2019

Related U.S. Application Data

(63) Continuation-in-part of application No. 15/434,371, filed on Feb. 16, 2017, now Pat. No. 10,633,897.

(51) Int. Cl.
*E05B 17/20* (2006.01)
*E05B 9/02* (2006.01)
(Continued)

(52) U.S. Cl.
CPC ..... *E05B 17/2053* (2013.01); *E05B 9/02* (2013.01); *E05B 39/007* (2013.01);
(Continued)

(58) Field of Classification Search
CPC ..... Y10T 292/0864; Y10T 292/1028; Y10T 292/1043; Y10T 292/1083;
(Continued)

(56) References Cited

U.S. PATENT DOCUMENTS 16,228 A 12/1856 Copeland
30,408 A 10/1860 Judd
(Continued)

FOREIGN PATENT DOCUMENTS

GB 2 286 627 8/1995
GB 2 461 079 12/2009
(Continued)

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Kristina R Fulton
*Assistant Examiner* — Faria F Ahmad
(74) *Attorney, Agent, or Firm* — Thomas A. O'Rourke; Bodner & O'Rourke, LLP

(57) ABSTRACT

A tamper-resistant sash window lock includes a housing, a shaft, a cam, and a lever member. An interior surface of the housing wall that defines a cavity. A portion of the interior surface of the housing wall is curved about a hole in the housing, with a distal end of the wall portion formed into a lock surface. The shaft is rotatably mounted in the hole, and a hub of the cam is rotatably mounted on the shaft. The cam has a cantilevered arm with a lock surface and an engagement surface. The lever member is fixedly secured to the shaft, for a first side thereof to engage and drive the cam hub in a first rotational direction into a lock position when the shaft is actuated in the first rotational direction, so the lock surface of the cantilevered arm engages the lock surface of the housing preventing forced entry.

16 Claims, 18 Drawing Sheets

(51) Int. Cl.

| | |
|---|---|
| ***E05C 3/04*** | (2006.01) |
| ***E05B 39/00*** | (2006.01) |
| ***E05B 65/08*** | (2006.01) |
| ***E05B 15/00*** | (2006.01) |
| ***E05C 7/00*** | (2006.01) |
| ***E05B 3/10*** | (2006.01) |

(52) U.S. Cl.

CPC ..... *E05B 65/0841* (2013.01); *E05C 3/046* (2013.01); *E05B 3/10* (2013.01); *E05B 15/0053* (2013.01); *E05B 17/2019* (2013.01); *E05C 3/04* (2013.01); *E05C 3/045* (2013.01); *E05C 2007/007* (2013.01); *E05Y 2900/148* (2013.01); *Y10S 292/20* (2013.01); *Y10S 292/47* (2013.01); *Y10T 292/0864* (2015.04); *Y10T 292/104* (2015.04); *Y10T 292/1039* (2015.04); *Y10T 292/1041* (2015.04); *Y10T 292/1043* (2015.04); *Y10T 292/1083* (2015.04)

(58) Field of Classification Search

CPC ..... Y10T 292/1089; Y10T 292/1039; Y10T 292/1041; Y10T 292/104; Y10T 70/5146; Y10T 70/515; E05C 2007/007; E05C 3/04; E05C 3/046; E05C 3/045; E05C 1/12; E05B 9/02; E05B 65/0841; E05B 3/10; E05B 15/004; E05B 17/2019; Y10S 292/20; Y10S 292/47

See application file for complete search history.

(56) References Cited

U.S. PATENT DOCUMENTS

| | | | |
|---|---|---|---|
| 36,524 | A | 9/1862 | Minor |
| 51,222 | A | 11/1865 | Ridell |
| 108,778 | A | 11/1870 | Gorman |
| 115,781 | A | 6/1871 | Steele |
| 126,872 | A | 5/1872 | Buckman |
| 148,857 | A | 3/1874 | Smith |
| 163,008 | A | 5/1875 | Gillespie |
| 166,842 | A | 8/1875 | Berryman |
| 178,360 | A | 6/1876 | Cooper |
| 190,074 | A | 4/1877 | Penfield |
| 192,614 | A | 7/1877 | Andrews |
| 192,919 | A | 7/1877 | Hoyt |
| 201,146 | A | 3/1878 | Adler |
| 226,033 | A | 3/1880 | Burns |
| 230,476 | A | 7/1880 | Green |
| 234,387 | A | 11/1880 | Burgess |
| 284,993 | A | 9/1883 | Abele |
| 314,350 | A | 3/1885 | Smith |
| 316,285 | A | 4/1885 | McKeen |
| 331,005 | A | 11/1885 | Sahr |
| 336,302 | A | 2/1886 | Dudgeon |
| 346,788 | A | 8/1886 | Teufel |
| 350,678 | A | 10/1886 | Hussey |
| 353,287 | A | 11/1886 | Chumard |
| 368,595 | A | 8/1887 | King |
| 369,885 | A | 9/1887 | Shaw |
| 375,656 | A | 12/1887 | Shaw |
| 376,252 | A | 1/1888 | McIntyre |
| 379,910 | A | 3/1888 | Rosentreter |
| 410,728 | A | 9/1889 | Brown |
| 417,868 | A | 12/1889 | Janes |
| 423,761 | A | 3/1890 | Hasenpflug |
| 426,303 | A | 4/1890 | McGovern |
| 447,068 | A | 2/1891 | Dixon |
| 402,723 | A | 5/1891 | Schmalhausen |
| 471,363 | A | 3/1892 | Sioan |
| 480,148 | A | 8/1892 | Theby |
| 493,159 | A | 3/1893 | Gibson |
| 509,941 | A | 12/1893 | Perry |
| 512,593 | A | 1/1894 | Webster |
| 520,754 | A | 5/1894 | Burmeister |
| 526,118 | A | 9/1894 | Sharp |
| 528,656 | A | 11/1894 | Burmeister |
| 530,078 | A | 12/1894 | Ammerman |
| 534,185 | A | 2/1895 | Winchester |
| 537,258 | A | 4/1895 | Wicox |
| 539,030 | A | 5/1895 | Bitner |
| 551,181 | A | 12/1895 | Dillon |
| 551,242 | A | 12/1895 | Wallace |
| 554,448 | A | 2/1896 | Keil |
| 564,426 | A | 7/1896 | Hubbard |
| 572,591 | A | 12/1896 | Woodard |
| 587,424 | A | 8/1897 | Bonine |
| 590,225 | A | 9/1897 | Hill |
| 653,458 | A | 7/1900 | Paquette |
| 666,596 | A | 1/1901 | Breen |
| 683,928 | A | 10/1901 | Geraghty |
| 688,491 | A | 12/1901 | Sigler |
| 695,736 | A | 3/1902 | Kendrick |
| 698,742 | A | 4/1902 | Schamweber |
| 699,696 | A | 5/1902 | Mellen |
| 708,406 | A | 9/1902 | Robson |
| 714,343 | A | 11/1902 | Wellman |
| 718,007 | A | 1/1903 | Linn |
| 719,981 | A | 2/1903 | Adams |
| 722,162 | A | 3/1903 | St. Louis |
| 724,466 | A | 4/1903 | Hannan |
| 743,716 | A | 11/1903 | Hadka |
| 744,755 | A | 11/1903 | Hasenpflug |
| 745,888 | A | 12/1903 | McElwee |
| 749,469 | A | 1/1904 | Assorati |
| 756,453 | A | 4/1904 | Arens |
| 756,559 | A | 4/1904 | Arens |
| 757,249 | A | 4/1904 | Barnard |
| 759,642 | A | 5/1904 | Sparks |
| 764,493 | A | 7/1904 | Noseworthy |
| 769,386 | A | 9/1904 | Johnson |
| 769,767 | A | 9/1904 | Phelps |
| 774,536 | A | 11/1904 | Saunders |
| 775,602 | A | 11/1904 | Heamshaw |
| 800,043 | A | 9/1905 | Witte |
| 804,994 | A | 11/1905 | Andrews |
| 815,537 | A | 3/1906 | Kissinger |
| 833,900 | A | 10/1906 | Sigler |
| 837,811 | A | 12/1906 | Ebbeson |
| 840,427 | A | 1/1907 | Brister |
| 865,090 | A | 9/1907 | Eddy |
| 866,073 | A | 9/1907 | Saunders |
| 878,206 | A | 2/1908 | Johnson |
| 881,658 | A | 3/1908 | Bowman |
| 886,108 | A | 4/1908 | Alien |
| 887,690 | A | 5/1908 | Pearce |
| 922,894 | A | 5/1908 | Heid |
| 897,719 | A | 9/1908 | Daubaignan |
| 900,079 | A | 10/1908 | Bittorf |
| 910,850 | A | 1/1909 | Petrie |
| 913,730 | A | 3/1909 | Kapus |
| 926,899 | A | 7/1909 | Roy |
| 928,408 | A | 7/1909 | Taube |
| 948,628 | A | 2/1910 | Jefferis |
| 969,150 | A | 5/1910 | Morris |
| 963,983 | A | 7/1910 | Bernhard |
| 966,063 | A | 8/1910 | Toothaker |
| 976,777 | A | 11/1910 | Brown |
| 980,131 | A | 12/1910 | Shean |
| 998,642 | A | 7/1911 | Shean |
| 1,003,386 | A | 9/1911 | Welker |
| 1,006,211 | A | 10/1911 | Hermon |
| 1,020,454 | A | 3/1912 | Setdenbecker |
| 1,041,803 | A | 10/1912 | Kilburn |
| 1,051,918 | A | 2/1913 | Rowley |
| 1,059,999 | A | 4/1913 | James |
| 1,069,079 | A | 7/1913 | Voight |
| 1,077,487 | A | 11/1913 | Miller |
| 1,080,172 | A | 12/1913 | Rusk |
| 1,100,820 | A | 6/1914 | Edwards |
| 1,121,228 | A | 12/1914 | Burkhas |
| 1,122,026 | A | 12/1914 | O'Rourke |
| 1,127,835 | A | 2/1915 | Westlund |
| 1,133,217 | A | 3/1915 | Barton |

(56) References Cited

U.S. PATENT DOCUMENTS 1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Holllis
1,243,115 A 10/1917 Shur
1,244,725 A 10/1917 Gadke
1,253,810 A 1/1918 Gianninoto
1,261,274 A 4/1918 Newsam
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Ditiefsen
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedicher
1,387,302 A 8/1921 Rage
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,470,858 A 10/1923 Maxwell
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wilbert
1,605,717 A 11/1926 Gregg
1,619,031 A 3/1927 Ostrosky
1,622,742 A 3/1927 Shipman
1,656,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,877,177 A 9/1932 Hinderer
1,891,940 A 12/1932 McAllister
1,900,936 A 3/1933 Huttger
1,901,974 A 3/1933 Macy
1,918,114 A 7/1933 Lorenzen
1,922,062 A 8/1933 Sullivan
1,940,084 A 12/1933 Grasso
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stiilman
2,202,561 A 5/1940 Lahiere
2,232,965 A 2/1941 Perl
2,272,145 A 2/1942 Anderson
2,326,084 A 8/1943 Westrope
2,369,584 A 2/1945 Lundholm
2,452,521 A 10/1948 Johnson
2,480,016 A 8/1949 Granberg
2,480,988 A 9/1949 Walton
2,500,349 A 3/1950 Menns
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,581,816 A 1/1952 Schlueter
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,621,951 A 12/1952 Ostadai
2,645,515 A 7/1953 Thomas
2,648,967 A 8/1953 Hoimsten
2,670,982 A 3/1954 Benham
2,692,789 A 10/1954 Rivard
2,735,707 A 2/1956 Sylvan
2,758,862 A 8/1956 Endter
2,766,492 A 10/1956 Day
2,789,851 A 4/1957 Lickteig
2,818,919 A 1/1958 Sylvan
2,846,258 A 8/1958 Granberg
2,855,772 A 10/1958 Hillgren
2,884,276 A * 4/1959 Baptist ..... E05C 3/046
292/336
2,920,914 A 1/1960 Jenkins
2,941,832 A 6/1960 Grossman
2,997,323 A 8/1961 Riser
3,027,188 A 3/1962 Eichstadt
3,122,387 A 2/1964 Wakelin
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,425,729 A 2/1969 Bisbing
3,438,153 A 4/1969 Lemme
3,469,877 A 9/1969 Hutchison
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
3,930,678 A 1/1976 Alexander
4,054,308 A 10/1977 Prohaska
4,059,298 A 11/1977 Van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy

(56) References Cited

U.S. PATENT DOCUMENTS 4,587,759 A 5/1986 Gray
4,621,847 A 11/1986 Paulson
4,624,073 A 11/1986 Randall
4,639,021 A 1/1987 Hope
4,643,005 A 2/1987 Logas
4,655,489 A 4/1987 Bisbing
4,736,972 A * 4/1988 Mosch ..... E05C 3/046 292/204
4,801,164 A * 1/1989 Mosch ..... E05C 3/046 292/204
4,813,725 A 3/1989 Mosch
4,824,154 A 4/1989 Simpson
4,826,222 A 5/1989 Davis
4,827,685 A 5/1989 Schmidt
4,893,849 A 1/1990 Schlack
4,922,658 A 5/1990 Coddens
4,923,230 A 5/1990 Simpson
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,092,640 A 3/1992 Plummer
5,110,165 A 5/1992 Piltingsrud
5,127,685 A 7/1992 Dallaire
5,139,291 A 8/1992 Schultz
5,143,412 A 9/1992 Lindqvist
5,161,839 A * 11/1992 Piltingsrud ..... E05C 3/046 292/241
5,165,737 A 11/1992 Riegelman
5,183,310 A 2/1993 Shaughnessy
5,217,264 A 6/1993 Fier
5,219,193 A * 6/1993 Piltingsrud ..... E05B 13/002 292/106
5,244,238 A 9/1993 Lindqvisi
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Slormo
5,452,925 A 9/1995 Huang
5,454,609 A 10/1995 Slocomb
5,536,052 A 7/1996 Mater
5,553,903 A 9/1996 Prete
5,560,149 A 10/1996 Lafevre
5,575,116 A 11/1996 Carlson
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnson
5,791,700 A 8/1998 Biro
5,806,900 A 9/1998 Bratcher
5,829,196 A 11/1998 Maier
5,839,767 A 11/1998 Piltingsrud
5,901,499 A 5/1999 Delaske
5,901,501 A 5/1999 Fountaine
5,911,763 A 6/1999 Quesada
5,927,768 A 7/1999 Dallmann
5,970,656 A 10/1999 Maier
5,992,907 A 11/1999 Sheldon
6,000,735 A 12/1999 Jourdenais
6,086,121 A 7/2000 Buckland
6,116,665 A 9/2000 Subliskey
6,135,510 A 10/2000 Diginosa
6,139,071 A 10/2000 Hopper
6,142,541 A * 11/2000 Rotondi ..... E05C 3/046 292/241
6,155,615 A 12/2000 Schulz
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 5/2001 Schuitz
6,250,694 B1 6/2001 Weiland
6,279,266 B1 8/2001 Searcy
6,349,576 B2 2/2002 Subliskey
6,364,375 B1 4/2002 Szapucki
6,450,544 B2 9/2002 Rotondi
6,546,671 B2 * 4/2003 Mitchell ..... E05B 65/08 292/DIG. 20
6,565,133 B1 5/2003 Timothy
6,568,723 B2 5/2003 Murphy
6,588,150 B1 7/2003 Wong
6,592,155 B1 7/2003 Lemley
6,601,270 B2 * 8/2003 Eckhardt ..... E05B 15/004 16/412
6,607,221 B1 8/2003 Elliot
6,631,931 B2 10/2003 Magnusson
6,634,683 B1 10/2003 Brannan
6,688,659 B2 2/2004 Kobrehei
6,817,142 B2 11/2004 Marshik
6,848,728 B2 2/2005 Rotondi
6,871,885 B2 3/2005 Goldenberg
6,871,886 B2 * 3/2005 Coleman ..... E05B 17/2003 292/241
6,877,784 B2 4/2005 Kelley
6,925,758 B2 8/2005 Petit
6,957,513 B2 10/2005 Pettit
6,983,963 B2 1/2006 Eslick
7,000,957 B2 2/2006 Lawrence
7,013,603 B2 3/2006 Eenigenburg
7,017,957 B2 5/2006 Murphy
7,036,851 B2 5/2006 Romig
7,063,361 B1 6/2006 Lawrence
7,070,211 B2 7/2006 Polawinczak
7,070,215 B2 7/2006 Kelley
7,100,951 B2 9/2006 Jien
7,147,255 B2 12/2006 Goldenberg
7,159,908 B2 * 1/2007 Liang ..... E05B 17/208 292/240
7,171,784 B2 2/2007 Eenigenburg
7,296,831 B2 11/2007 Generowicz
7,322,619 B2 1/2008 Nolte
7,322,620 B1 * 1/2008 Lawrence ..... E05B 17/208 292/240
7,407,199 B2 * 8/2008 Richardson ..... E05B 63/20 292/163
7,431,356 B2 10/2008 Liang
7,441,811 B2 10/2008 Lawrence
7,481,470 B2 1/2009 Eenigenburg
7,510,221 B2 3/2009 Eenigenburg
7,530,611 B2 5/2009 Liang
7,559,588 B2 7/2009 Liang
7,591,494 B2 * 9/2009 Mitchell ..... E05B 63/185 292/336
7,607,262 B2 10/2009 Pettit
7,637,544 B2 12/2009 Liang
7,665,775 B1 2/2010 Miller
7,699,365 B2 * 4/2010 Liang ..... E05B 41/00 292/240
7,922,223 B2 * 4/2011 Lawrence ..... E05C 3/046 292/241
7,963,577 B2 * 6/2011 Wolf ..... E05C 3/046 292/241
7,976,077 B2 7/2011 Flory
8,002,317 B2 * 8/2011 Satram ..... E05C 1/12 292/336
8,205,919 B2 6/2012 Flory
8,205,920 B2 6/2012 Flory
8,220,846 B2 7/2012 Liang
8,231,148 B2 7/2012 Van Der Kooij
8,235,430 B2 8/2012 Liang

(56) References Cited

U.S. PATENT DOCUMENTS 8,272,164 B2 9/2012 Albrecht
8,336,930 B2 * 12/2012 Liang ..... E05B 15/0053 292/242
8,360,484 B2 1/2013 Liang
8,414,039 B2 4/2013 Liang
8,511,724 B2 8/2013 Liang
8,550,507 B2 10/2013 Barton
8,567,830 B2 * 10/2013 Liang ..... E05C 3/046 292/240
8,657,347 B2 2/2014 Liang
8,726,572 B2 5/2014 Detham
8,789,857 B2 * 7/2014 Liang ..... E05B 17/2019 292/111
8,789,862 B2 7/2014 Liang
8,833,809 B2 9/2014 Liang
8,844,985 B2 9/2014 Liang
8,870,244 B2 10/2014 Liang
8,881,461 B2 11/2014 Derham
9,103,144 B2 8/2015 Liang
9,140,033 B2 9/2015 Woif
9,376,834 B2 6/2016 Liang
9,493,970 B2 11/2016 Campbell
9,816,300 B2 11/2017 Derham
10,119,310 B2 * 11/2018 Liang ..... E05B 63/0056
2001/0005995 A1 * 7/2001 Subliskey ..... E05B 65/0841 70/89
2004/0026932 A1 * 2/2004 Coleman ..... E05B 17/2003 292/241
2006/0087130 A1 * 4/2006 Liang ..... E05B 15/102 292/242
2006/0192391 A1 8/2006 Pettit
2006/0244270 A1 11/2006 Rotondi
2007/0085350 A1 * 4/2007 Liang ..... E05B 41/00 292/240
2007/0205615 A1 * 9/2007 Eenigenburg ..... E05C 3/046 292/241
2008/0012358 A1 1/2008 Liang
2008/0022728 A1 1/2008 Flory
2008/0169658 A1 7/2008 Wolf
2010/0199726 A1 8/2010 Varney
2010/0218425 A1 9/2010 Nolte
2010/0263415 A1 10/2010 Rupsil
2011/0271720 A1 * 11/2011 Zheng ..... E05C 3/042 70/89
2011/0304163 A1 * 12/2011 Liang ..... E05C 3/046 292/242
2012/0313386 A1 * 12/2012 Liang ..... E05B 3/04 292/224
2012/0313387 A1 * 12/2012 Liang ..... E05B 15/004 292/224
2013/0214545 A1 8/2013 Wolf
2013/0283695 A1 10/2013 Hollerman
2014/0035297 A1 * 2/2014 Kreuser ..... E05C 3/046 292/202
2016/0076282 A1 3/2016 Wolf
2017/0152688 A1 * 6/2017 Liang ..... E06B 3/5063

FOREIGN PATENT DOCUMENTS

GB 2 461 107 12/2009
GB 2 461 108 12/2009

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.
"Engineering Fit," available at: https://en.wikipedia.org/wiki/Engineering_fit, Jul. 8, 2019.

* cited by examiner

TAMPER RESISTANT SASH LOCK

CROSS REFERENCES TO RELATED APPLICATIONS

This application is a continuation in part of U.S. application Ser. No. 15/434,371, filed on Feb. 16, 2017, titled "Tamper Resistant Lock." the disclosures of which are incorporated herein by reference.

FIELD OF THE INVENTION

The subject technology relates generally to the field of window locks, and more particularly is directed to a lock for use on sash windows or doors, and which is configured to be tamper-resistant.

BACKGROUND OF THE INVENTION

Single hung and double hung sliding windows and doors are known in the art, and are often utilized in the construction of homes and other dwellings, and even offices. Sash locks are typically used to secure the lower sash member in a closed position, if the upper sash is not moveable, or may be used to secure both the upper and lower sash member in a closed position, where both are slidable within a master window frame. Most sash locks are mounted to the meeting rail of the lower sash window, and use a rotatable cam that may engage a keeper in a locked position, which keeper may be attached to the upper sash window or to the master window frame.

The lock of the present invention is particularly configured for the cam that locks and engages the keeper, to be tamper-resistant with respect to a person attempting to manipulate the cam from the exterior.

OBJECTS OF THE INVENTION

It is an object of the invention to provide a lock that is capable of locking the lower sash of a sliding sash window, and is capable of locking both an upper sash and a lower sash window, where both the upper and lower sashes are slidable.

It is another object of the invention to provide a sash window lock capable of locking one or more sashes of a sliding sash window.

It is a further object of the invention to provide a latch for preventing the cam of the sash lock from being surreptitiously operated by an unauthorized party on the outside of the window.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment, the herein disclosed tamper-resistant lock for a sash window may broadly include a housing, a shaft, a cam, and a lever member. The housing may have a wall shaped to form an exterior surface, and an interior surface that defines a cavity, and may have a substantially cylindrical hole in the wall that interconnects the exterior to the interior. A portion of the interior surface of the wall is curved about the substantially cylindrical hole, with a distal end of the portion of the interior surface being formed into a lock surface. In one embodiment, the curved portion of the interior surface of the wall may be formed as an arcuate surface that is substantially concentric with the cylindrical hole.

A substantially cylindrical shaft is rotatably mounted in the substantially cylindrical hole of the housing, which shaft may be formed with a handle portion that may be substantially perpendicular to an axis of the shaft. The cam may have a hub with a substantially cylindrical hole to rotatably mount the cam to the cylindrical shaft. The cam is formed with an arm that may cantilever away from the hub, with a distal end of the arm being formed with a lock surface and an engagement surface. The hub of the cam may also be formed with a recess having a first end and a second end (or alternatively may be formed with a first protrusion and a second protrusion).

The lever member is fixedly secured to the shaft, for a first side of the lever member to engage the hub of the cam at the first end of the recess (or instead engages the first protrusion) to drive the cam in a first rotational direction when the shaft is actuated in the first rotational direction, and for a second side of the lever member to engage the hub of the cam at the second end of the recess (or instead engages the second protrusion) to drive the cam in a second rotational direction when the shaft is actuated in the second rotational direction. The lever member may also be formed with an engagement surface.

When the shaft is rotated in the first rotational direction, the lever member drives the cam into a lock position where it engages a keeper secured to either the upper sash window or the master window frame, to lock the sash window when in a closed window position. When the cam has been driven into the locked position, the lock surface of the cantilevered arm is engaged with the lock surface of the housing. In various embodiments for the arrangement and particular shape of the parts of the lock, they may be formed such that when the cam is in the lock position, an apex of the engagement surface of the lever member may be just short of directly abutting, or may instead directly abut an apex of the engagement surface of the cantilevered arm, which engagement surfaces may be curved (e.g., semicircular). Alternatively, the lock surface of the housing may be formed as a flat surface; and the lock surface of the cantilevered member may also be formed as a flat surface. The cantilevered arm of the cam may be formed such that it may be biased into contact with the curved portion of the interior surface of the housing wall, when the cam is mounted to the shaft, so that the lock surface of the cantilevered arm is biased into engagement with the lock surface of the housing merely as a result of the rotation of the cam into the lock position.

In addition, after the cam has been driven by the lever member into the lock position, an apex of the engagement surface of the lever member may be rotated past an apex of the engagement surface of the cantilevered arm, to positively drive the outward radial movement of, and positive contact between, the lock surface of the cantilevered arm, with respect to the lock surface of the housing. This rotation of the apex of the engagement surface of the lever member past the apex of the engagement surface of the cantilevered arm may provide for over-center securement of the cantilevered arm by the lever member (i.e., any external force applied by an intruder attempting to counter-rotate the cam from the outside to unlock the lock and gain unauthorized entry will be opposed/reacted by the cam bearing against a stop through the lever member).

It may be understood that upon rotation of the shaft in the second rotational direction, the lever member may drive the cam in the second rotational direction to cause the lock surface of the cantilevered arm to disengage from the lock surface of the housing, and subsequently drive the cam into an unlock position, where it is disengaged from the keeper. It is noted that the first end and the second end of the recess in the cam may be spaced apart such that a first portion of the rotation of the shaft in the second rotational direction may be without the cam being driven by the lever member, and that a second portion of the rotation of the shaft in the second rotational direction may thereafter cause the lever member to drive the cam in the second rotational direction.

BRIEF DESCRIPTION OF THE DRAWINGS

The description of the various example embodiments is explained in conjunction with appended drawings, in which:

FIGS. 58-62 are a sequence of bottom views of the sash lock assembly, shown with the shaft/handle member at various degrees of rotation, in which:

FIG. 58 is a bottom view of the sash lock assembly shown with the shaft/handle member in the zero degree position and the cam in the unlocked position;

FIG. 59 shows the sash lock assembly of FIG. 58 but after the shaft/handle member has been rotated sufficiently for the lever member to just contact a first end of a recess in the cam, without yet driving it to co-rotate;

FIG. 60 shows the sash lock assembly of FIG. 59 but after the shaft/handle member has been rotated further for the lever member to drive the cam until a lock surface of a cantilevered arm of the cam has been biased to engage the lock surface of the housing;

FIG. 61 shows the sash lock assembly of FIG. 60 but after the shaft/handle member has been rotated a little further for the lever member to drive the cam to cause the distal end of the cantilevered arm to deform, for the lock surface of the cantilevered arm of the cam to be further engaged and in contact with the lock surface of the housing;

FIG. 62 shows the sash lock assembly of FIG. 61 but after the shaft/handle member has been rotated a small amount further, being roughly 180 degrees of total rotation, for the lever member to drive the engagement surface of the cam to cross over an apex of the engagement surface of the cantilevered member of the cam, for over-center securement of the cam by the lever member;

DETAILED DESCRIPTION OF THE INVENTION

Figure 1B:
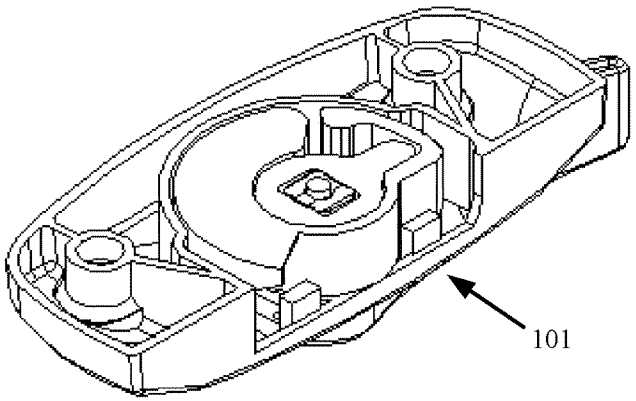
FIG. 1B shows the parts of FIG. 1A assembled into the first embodiment of the herein disclosed tamper resistant sash lock.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed apparatus.

Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of multiple individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator." available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit (e.g., for a 0.1250 inch shaft diameter the opening may be 0.1285 inches for a close fit and may be 0.1360 inches for a free (running) fit: and for a 0.5000 inch diameter shaft size the opening may be 0.5156 inches for a close clearance fit and may be 0.5312 inches for a free clearance fit). Other clearance amounts may also be used.

The tamper-resistant lock 101 may be used to secure many different fenestration products that have a member or members that may move (e.g., slide) with respect to another. For example, the lock 101 may be used to secure one or more sashes of a sliding sash window assembly (or a sliding sash door assembly), the sash window assembly having a lower sash window formed with a meeting rail, a bottom rail, and a pair of stiles, being slidably disposed in a master window frame, and an upper sash window. A rotatable cam of the lock may be releasably secured to a keeper that may be mounted on the upper sash window of the master window frame.

Figure 1A:
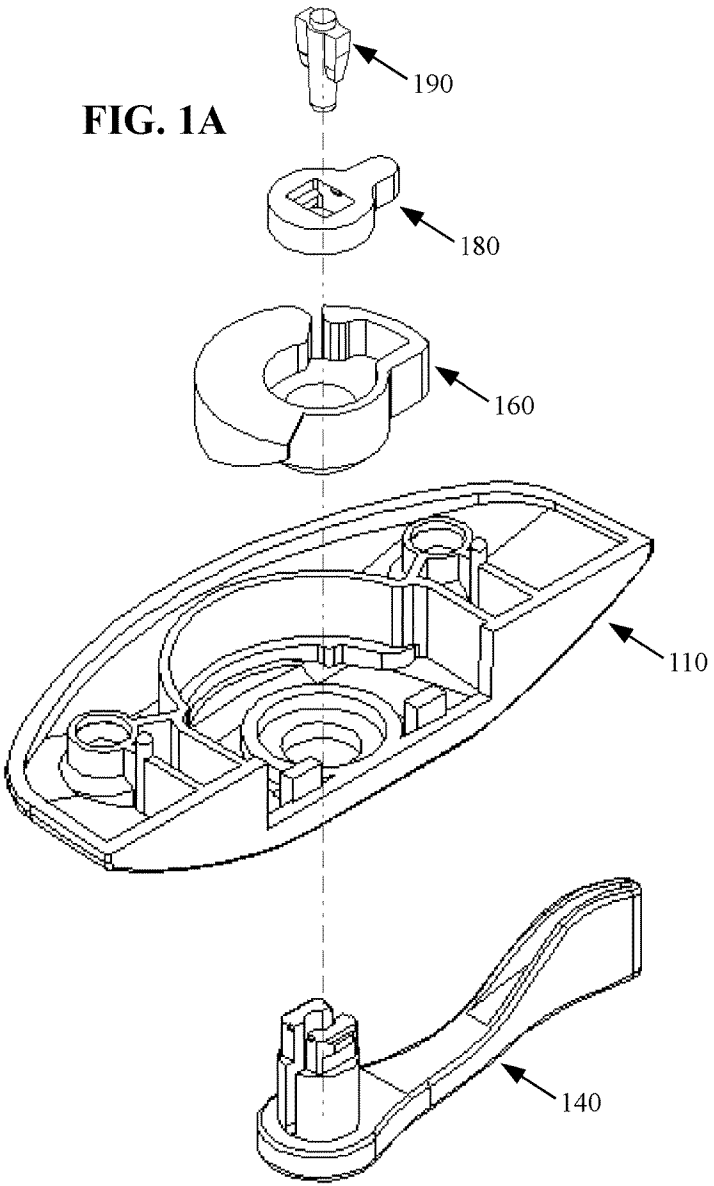
FIG. 1A is an exploded view of the parts that may be used to form a first embodiment of the herein disclosed tamper resistant sash lock.

In accordance with at least one embodiment of the present invention, the tamper-resistant lock may broadly include a housing 110, a shaft/handle member 140, a cam 160, and a lever member 180. In another embodiment, as shown in the exploded view of FIG. 1A and the assembled view of FIG. 1B, a tamper-resistant lock 101 may additionally include a wedge pin 190, as discussed hereinafter.

Figure 2A:
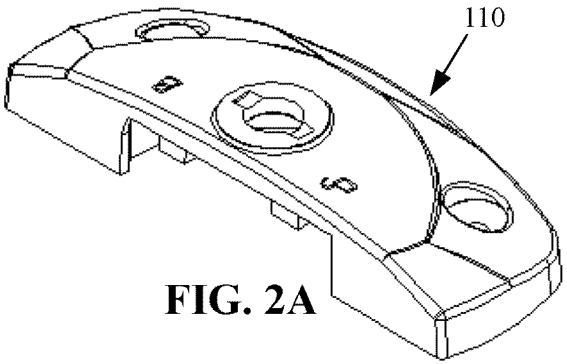
FIG. 2A is a top perspective view of the housing of the herein disclosed tamper resistant sash lock.
Figure 2B:
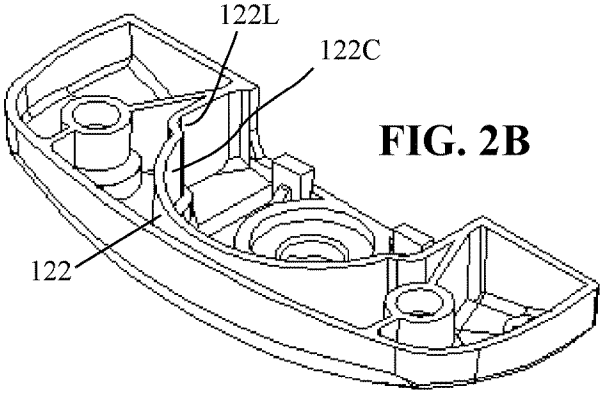
FIG. 2B is a bottom perspective view of the housing of FIG. 1.
Figure 7:
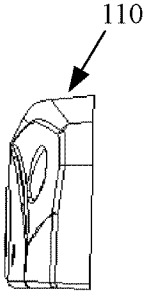
FIG. 7 is a first side view of the housing of FIG. 1.
Figure 4:
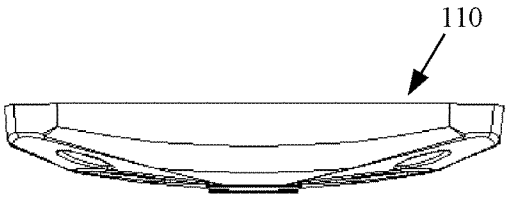
FIG. 4 is a front view of the housing of FIG. 1.
Figure 3:
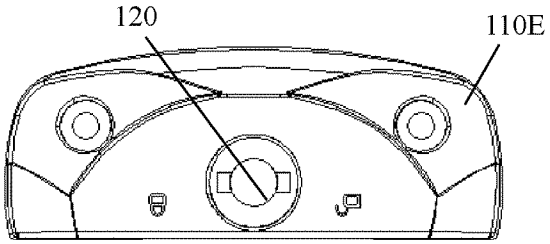
FIG. 3 is a top view of the housing of FIG. 1.
Figure 5:
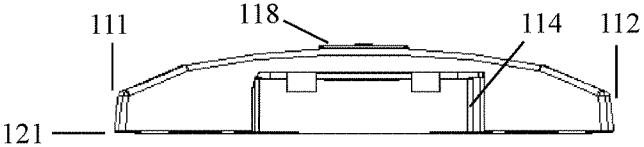
FIG. 5 is a rear view of the housing of FIG. 1.
Figure 6:
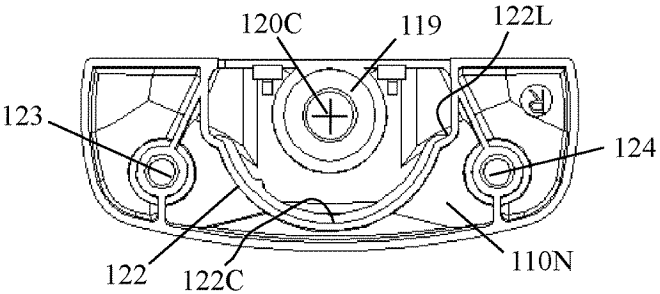
FIG. 6 is a bottom view of the housing of FIG. 1.
Figure 8:
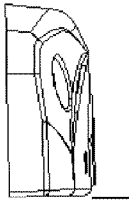
FIG. 8 is a second side view of the housing of FIG. 1.

Perspective views of the housing 110 are shown in FIGS. 2A-2B, while corresponding orthogonal views are shown in FIGS. 3-8. The housing 110 is not limited to the shape illustrated within those figures and could take on many different suitable shapes, including a rectangular shape, an irregular shape, etc. However, the housing 110 may desirably be formed of at least one wall that may be shaped to form an exterior surface 110E, and an interior surface 110N that defines a cavity, and which wall may terminate in a generally flat bottom surface 121 that may be configured to rest upon a top surface of a meeting rail of a sash window. The housing wall may span from a first end 111 to second end 112. The housing wall may also be shaped to form a generally flat side surface 113, which may also have an opening 114 that interconnects with the cavity.

The housing 111 may have a cylindrical boss 18 extending upwardly from the exterior surface 110E, and may also have a boss (or thickened area) 119 extending downwardly from the interior surface 110N into the housing cavity. The housing 110 may have a substantially cylindrical hole 120 through the boss 118 and boss 119, which may be used for pivotal mounting of the shaft/handle member 140 to the housing.

A portion of the interior surface of the wall of the housing 110 may transition to form a curved wall portion 122 having a curved surface 122C being curved about the substantially cylindrical hole 120. The curved surface 122C may preferably be an arcuate surface that may be formed to be concentric with the center 120C of the substantially cylindrical hole 120. A distal end of the curved surface 122C of the wall portion 122 of housing 110 may transition into a lock surface 122L.

As seen in FIGS. 11-18, a shaft/handle member 140 may have a cylindrical shaft 143. The shaft 143 may be configured to be pivotally received within the hole 120 of the housing 110. A first end of the shaft/handle member 140 may have a knob or other enlarged circular cross-sectional shape formed thereon to permit that end of the shaft to be easily grasped and actuated by the user. Alternatively, the first end of the shaft 143 may transition into a graspable handle portion 146 that may extend generally orthogonally with respect to the axis 143X of shaft 143. A second end of the shaft/handle member 140 may have the lever member 180 formed thereon or mounted thereto. In one embodiment, the cylindrical shaft 143 may terminate in a flat surface for mounting of the lever member 180 thereto. In another embodiment, the second end of the cylindrical shaft 143 may have a hole formed therein, which may receive a rivet or other fastener, for mounting of the lever member 180 thereto. Alternatively, extending downward from the cylindrical shaft 143 may be a protrusion 147 having a rectangular cross-section that may have an opening 148 that may include a circular hole portion 148H and may create prongs 151 and 152, which may exhibit some degree of flexibility. Extending from the outward facing side (the side opposite opening 148) of prongs 151 and 152 may be respective lips 151L and 152L, where the distal portion of each may be formed with an angled (e.g., chamfered) surface (151LA/152LA, see FIG. 18). The protrusion 147 and prongs 151/152 with the lips 151L/152L may provide for mounting thereto of corresponding features of the lever member 180, as discussed hereinafter. The opening 148 that may also be particularly shaped to receive the wedge pin 190 therein.

Figure 9:
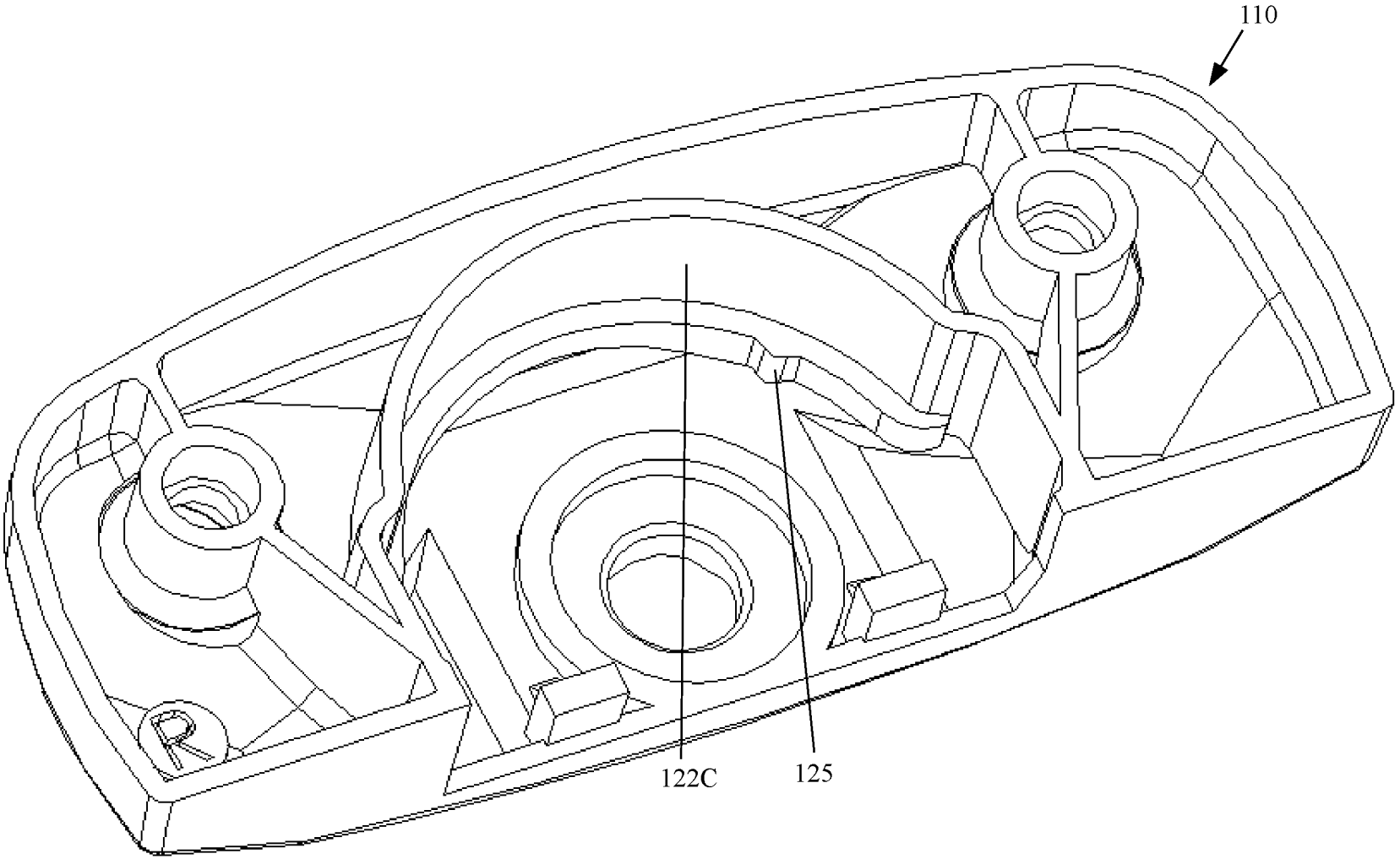
FIG. 9 is a second bottom perspective view of the housing of FIG. 1.
Figure 10:
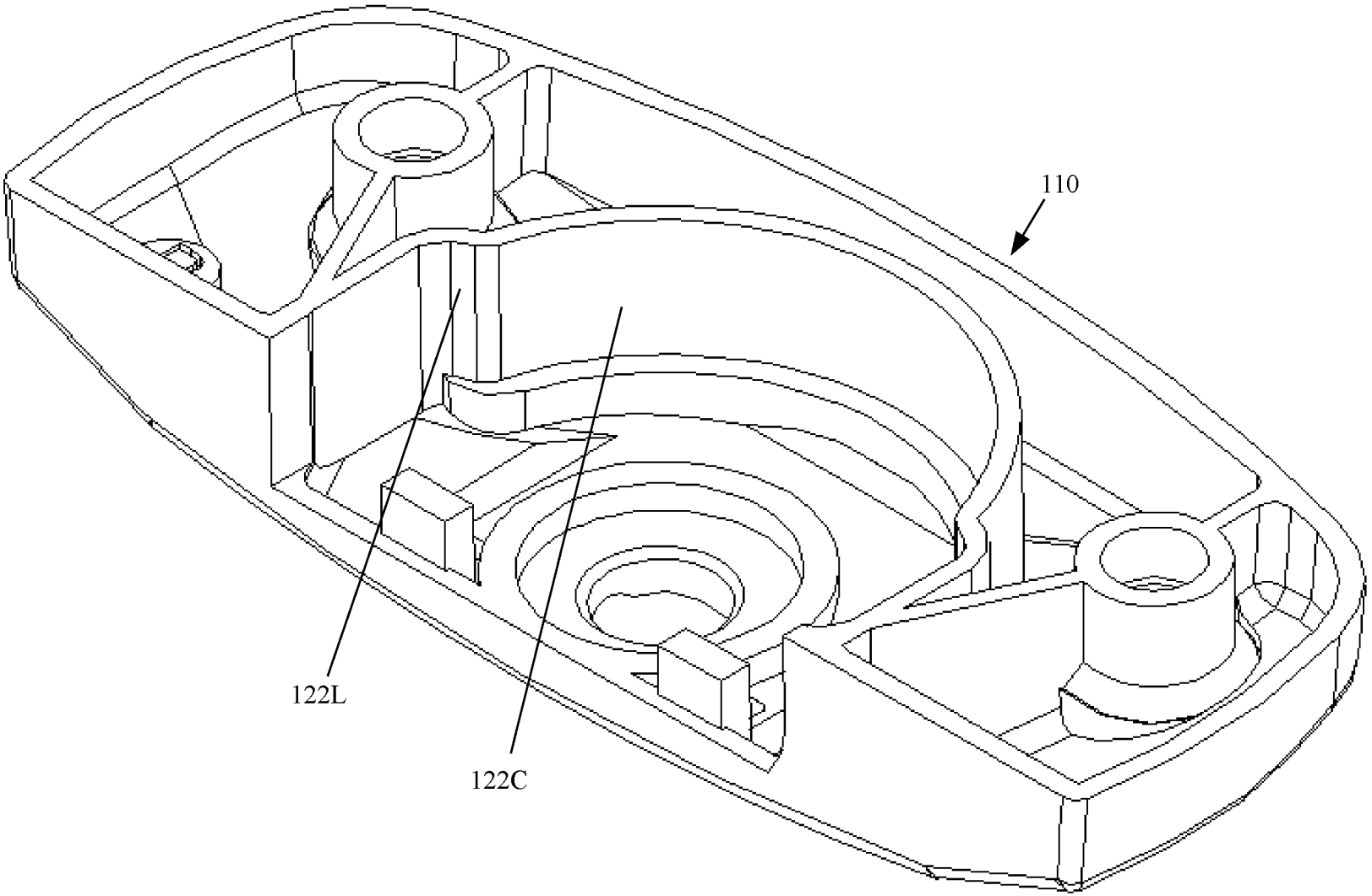
FIG. 10 is a third bottom perspective view of the housing of FIG. 1.
Figure 11:
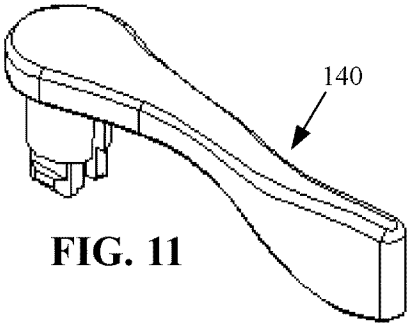
FIG. 11 is a top perspective view of the shaft and handle member of the herein disclosed tamper resistant sash lock.
Figure 12:
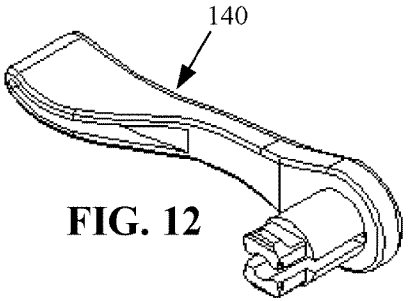
FIG. 12 is a side perspective view of the shaft and handle member of FIG. 11.
Figure 13:
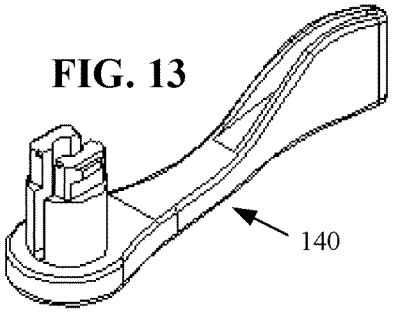
FIG. 13 is a bottom perspective view of the shaft and handle member of FIG. 11.
Figure 18:
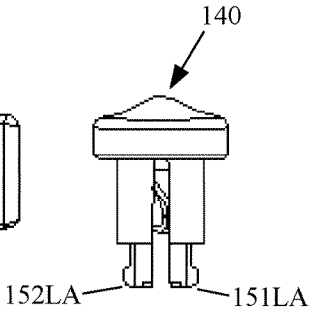
FIG. 18 is a second end view of the shaft and handle member of FIG. 11.
Figure 15:
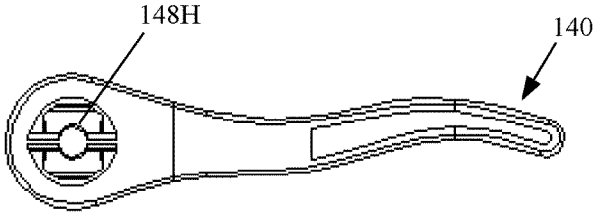
FIG. 15 is a bottom view of the shaft and handle member of FIG. 11.
Figure 14:
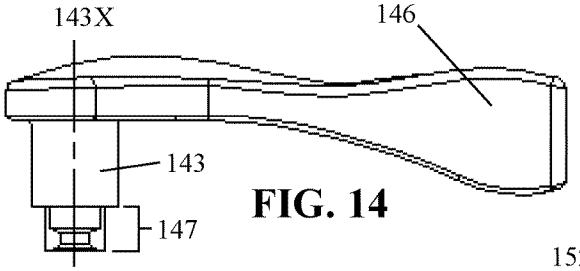
FIG. 14 is a side view of the shaft and handle member of FIG. 11.
Figure 16:
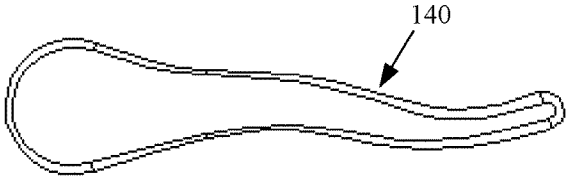
FIG. 16 is a top view of the shaft and handle member of FIG. 11.
Figure 17:
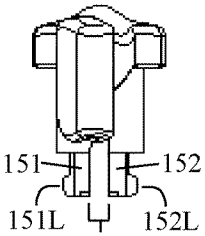
FIG. 17 is a first end view of the shaft and handle member of FIG. 11.
Figure 19:
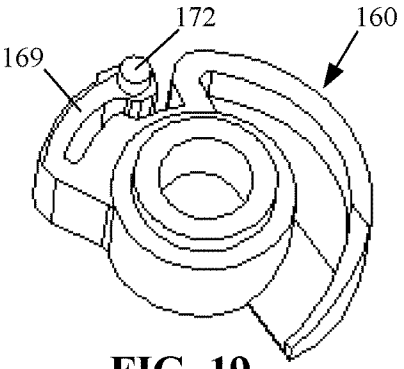
FIG. 19 is a first top perspective view of the cam of the herein disclosed tamper resistant sash lock.
Figure 20:
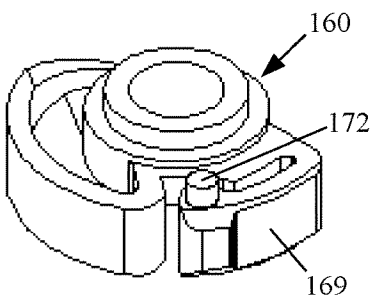
FIG. 20 is a second top perspective view of the cam of FIG. 19.
Figure 21:
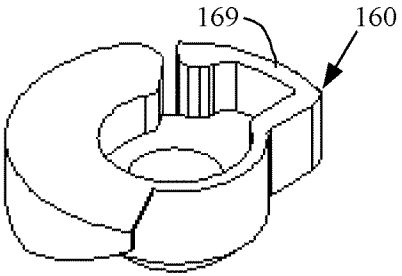
FIG. 21 is a first bottom perspective view of the cam of FIG. 19.
Figure 22:
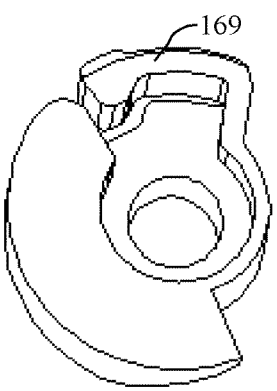
FIG. 22 is a second bottom perspective view of the cam of FIG. 19.
Figure 24:
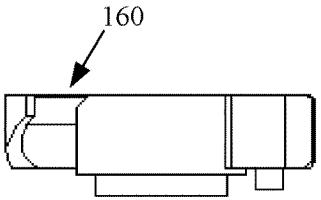
FIG. 24 is a first side view of the cam of FIG. 19.
Figure 23:
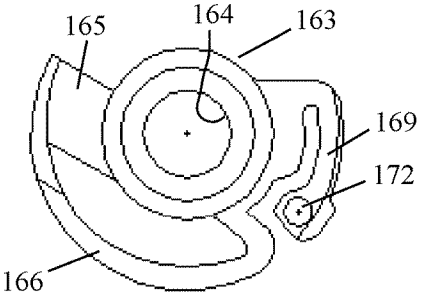
FIG. 23 is a top view of the cam of FIG. 19.
Figure 26:
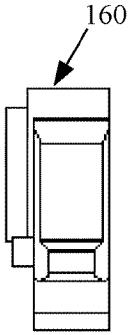
FIG. 26 is a first end view of the cam of FIG. 19.
Figure 25:
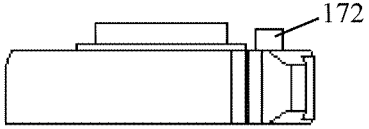
FIG. 25 is a second side view of the cam of FIG. 19.
Figure 27:
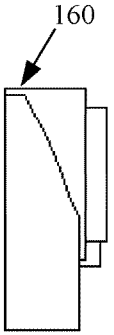
FIG. 27 is a second end view of the cam of FIG. 19.
Figure 28:
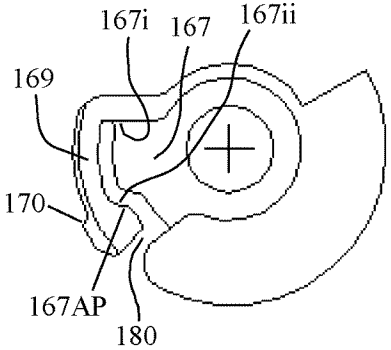
FIG. 28 is a bottom view of the cam of FIG. 19.
Figure 64:
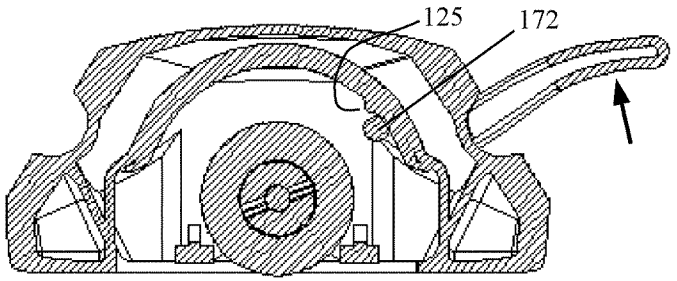
FIGS. 63-67 show a section cut through the sash lock for each of the shaft/handle member and lever arm and cam positions illustrated in FIGS. 58-62, showing the position of a cylindrical protrusion of the cantilevered member of the cam with respect to the corresponding protrusion on the housing, at each shaft/handle member position.
Figure 63:
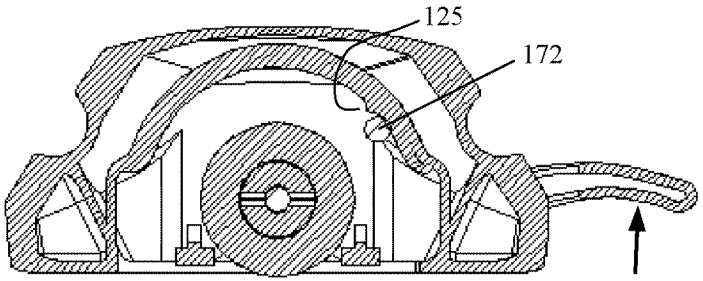
Figure 65:
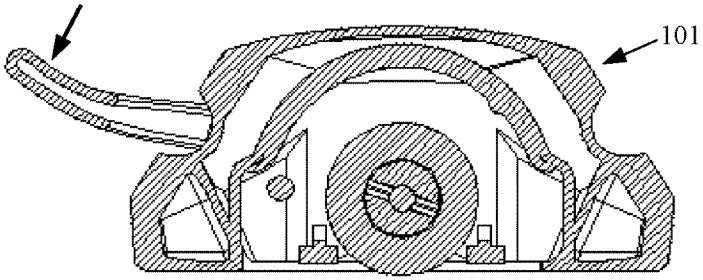
Figure 67:
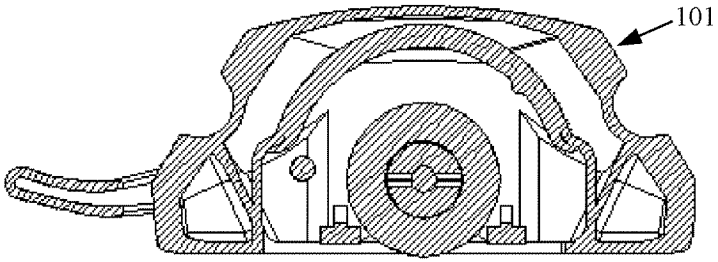
Figure 66:
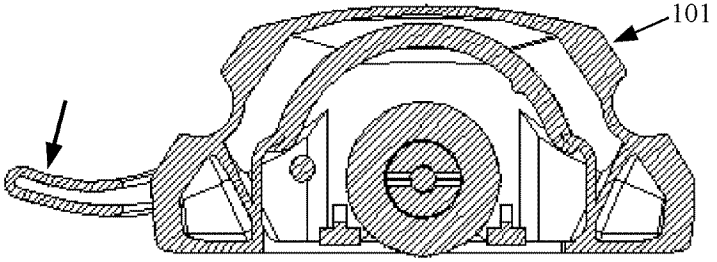
Figure 77:
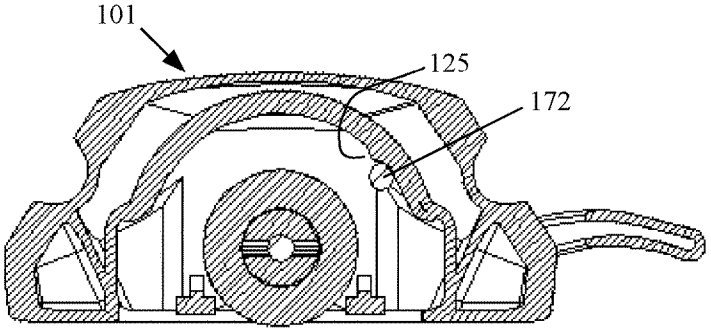

The locking cam 160, illustrated in FIGS. 19-28, may have a hub 163 that may be cylindrical, with a cylindrical hole 164 formed therein that is sized to permit the cam to thereby be pivotally mounted to the shaft 143 of the shaft/handle member 140. Extending laterally away from the hub 163 may be a wall 165, and extending laterally away from the wall 165 may be a curved cam wall 166, which may be used to engage a key of the corresponding keeper (e.g., key 91 of keeper 90 in FIG. 79), and draw the sliding sash window in closer proximity to the master window frame (or to the other sash window for a double-hung sash window). As seen in FIG. 28, one side of the hub 163 of the cam 160 may have a recess 167 having at least a contact surface 167*i* formed therein on one side of the recess. An opening 168 may be formed proximate to the periphery of the cam 160 to create a cantilevered arm 169, where at least a portion of the opening 168 may be arcuate to form a portion of the cantilevered arm that may similarly be arcuate, and where another portion of the opening 168 may form a portion of the cantilevered arm 169 that cantilevers away from the hub 163. At the end of the cantilevered arm 169 being distal from the portion that is connected to and extends away from the hub 163 may be formed a lock surface 170 and an engagement surface 167*ii* that may be generally curved, and which curved engagement surface may have an apex 167AP. The contact surface 167*i* and the engagement surface 167*ii* of the cam 160 may be formed relative to each other (i.e., may be clocked/spaced apart relative to each other) so that each may be respectively contacted by opposite sides of the lever arm 180, which may thereby drive the cam to rotate and counter-rotate, as discussed hereinafter. A protruding feature (e.g., cylindrical protrusion 172) may be formed on the cantilevered arm 169 of cam 160, and which protrusion may be positioned to engage a corresponding feature on the housing 110 (e.g., dual sloped protrusion 125—see FIG. 9) to act as a detent (see FIG. 64 and FIG. 77). The contact between the cylindrical protrusion 172 on the cam 160 with the sloped protrusion 125 on the housing 110 may provide a tactile indication to the hand of the user actuating the handle, as to when rotation of the shaft/handle member 140 has begun to drive the cam 160 to rotate away from the unlocked (retracted) position (see FIG. 59 and FIG. 64), or when the shaft/handle member 140 has driven the cam 160 back into the unlocked position (see FIGS. 76-77 and FIGS. 71-72).

Figure 29:
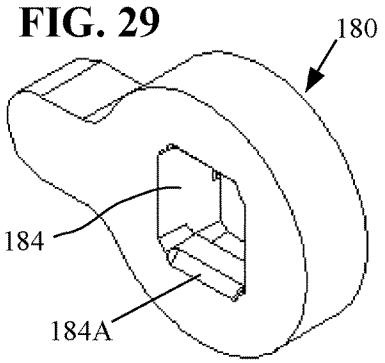
FIG. 29 is a first perspective view of the lever member of the herein disclosed tamper resistant sash lock.
Figure 30:
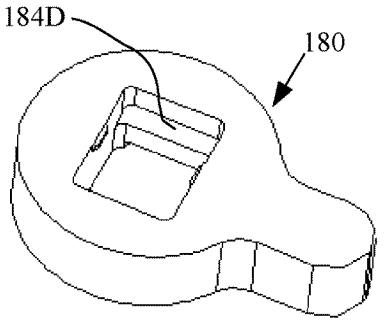
FIG. 30 is a second perspective view of the lever member of FIG. 29.
Figure 31:
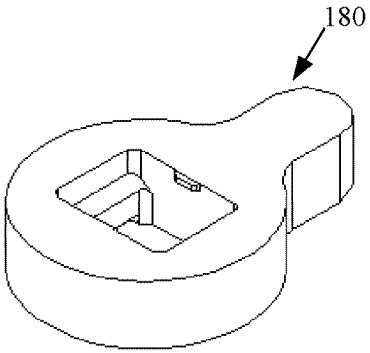
FIG. 31 is a third perspective view of the lever member of FIG. 29.
Figure 36:
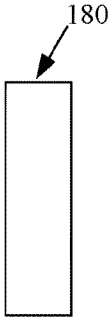
FIG. 36 is a first end view of the lever member of FIG. 29.
Figure 33:
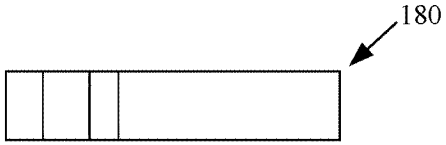
FIG. 33 is a first side view of the lever member of FIG. 29.
Figure 32:
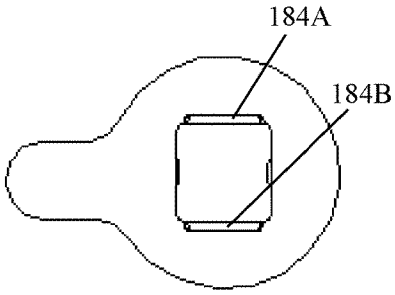
FIG. 32 is atop view of the lever member of FIG. 29.
Figure 34:
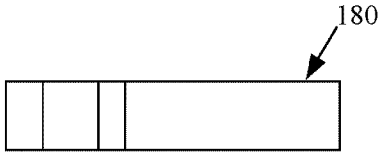
FIG. 34 is a second side view of the lever member of FIG. 29.
Figure 35:
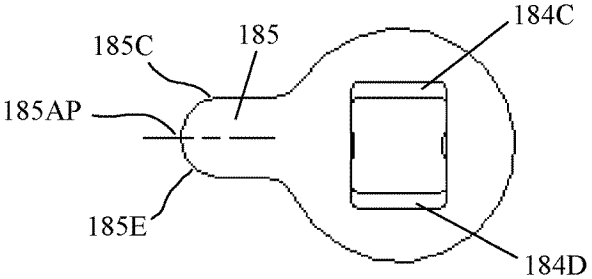
FIG. 35 is a bottom view of the lever member of FIG. 29.
Figure 37:
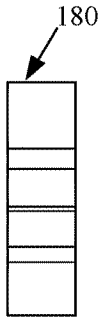
FIG. 37 is a second end view of the lever member of FIG. 29.
Figure 38:
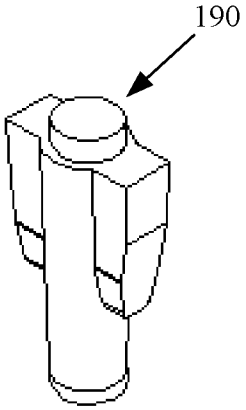
FIG. 38 is a first perspective view of the wedge pin of the herein disclosed tamper resistant sash lock.
Figure 39:
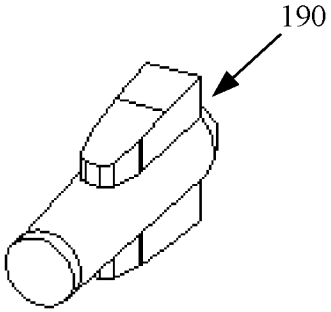
FIG. 39 is a second perspective view of the wedge pin of FIG. 38.
Figure 43:
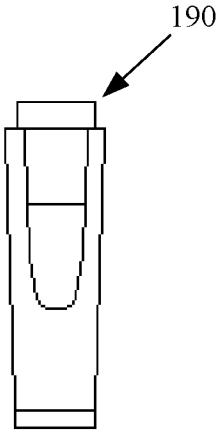
FIG. 43 is a side view of the wedge pin of FIG. 38.
Figure 41:
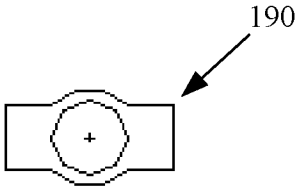
FIG. 41 is a top view of the wedge pin of FIG. 38.
Figure 40:
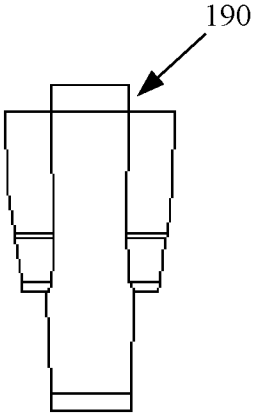
FIG. 40 is a front view of the wedge pin of FIG. 38.
Figure 42:
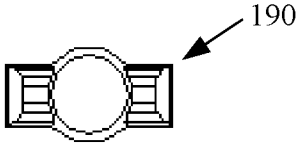
FIG. 42 is a bottom view of the wedge pin of FIG. 38.

The lever member 180, illustrated in FIGS. 29-37, may be positioned at the end of the shaft 143. In one embodiment lever member 180 may be integrally formed with the cylindrical shaft 143 of the shaft/handle member 140 and may be inserted through a slot in the cam. For ease of manufacturing, in another embodiment the lever member 180 may be formed as a flat plate which may be secured to the shaft 143 of the shaft/handle member 140 in any suitable manner (e.g., using adhesive, mechanical fastener(s), a welding process, etc.). In yet another embodiment the lever member 180 may be formed as a flat plate with a rectangular shaped recess 184 that may be sized to be received upon the rectangular shaped protrusion 147 at the end of the shaft 143. It may be received thereon in an interference fit. Alternatively, the rectangular shaped recess 184 may be sized to be received upon the rectangular shaped protrusion 147 in a clearance fit. Additionally, as seen in FIG. 29, two sides of the recess 184 in the lever member 180 may be formed with angled surfaces 184A/184B (FIG. 32) to accommodate sliding entry of the angled surfaces 151LA/152LA on the lips 151L/152L of the prongs 151/152 on the protrusion 147 of the shaft/handle member 140. The recess 184 in the lever member 180 may also have a pair of shoulders 184C/184D formed therein, on the side of the recess opposite the angled surfaces 151LA/152LA, which may accommodate the lips 151L/152L of the prongs 151/152 once the prongs spring outwardly after coupling of the lever member 180 to the shaft/handle member 140. The wedge pin 190 shown in FIGS. 38-42 may then be inserted into the opening 148 in the protrusion 147 of the shaft/handle member 140. The lever member 180 may also be formed with a protrusion 185, a portion of which may form a contact surface 185C, and an engagement surface 185E that may be curved and which may reach an apex 185AP.

Figure 46:
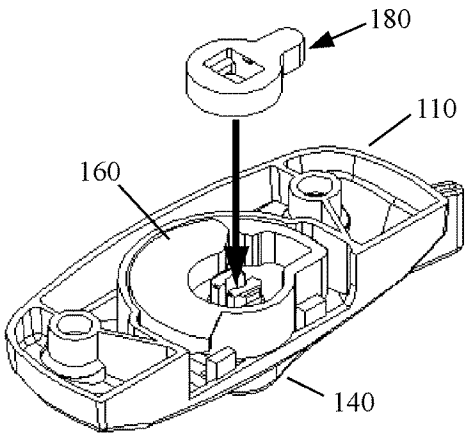
FIGS. 44-48 shows the assembly sequence for the housing of FIG. 1, the shaft and handle member of FIG. 11, the cam of FIG. 19, the lever member of FIG. 29, and the wedge pin of FIG. 38 to form the tamper resistant sash lock disclosed herein.
Figure 45:
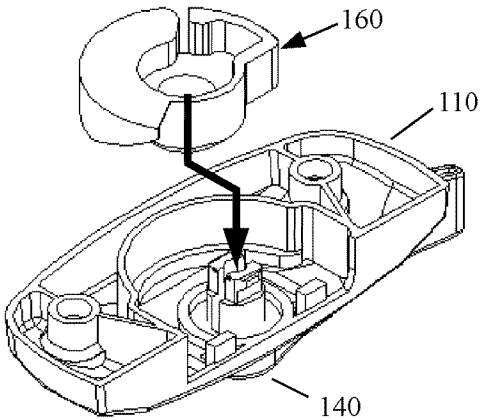
Figure 44:
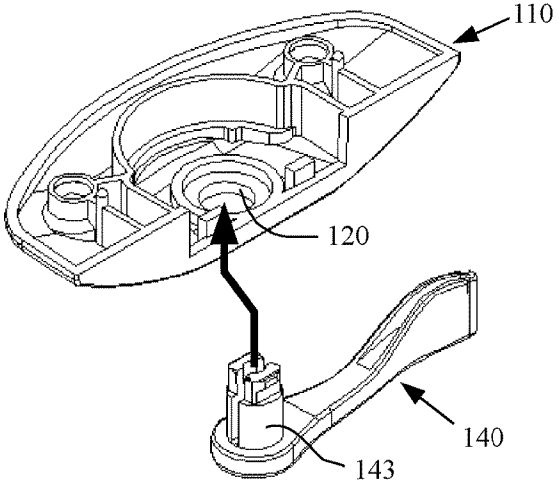
Figure 47:
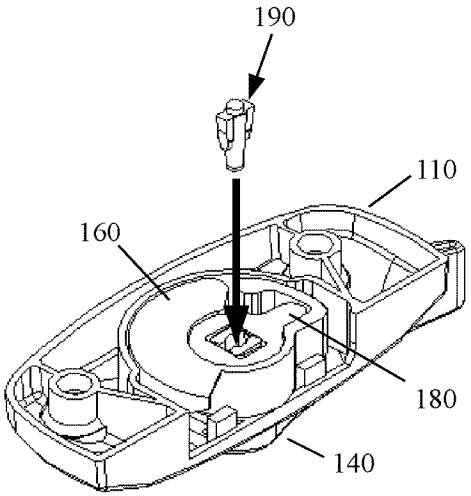
Figure 48:
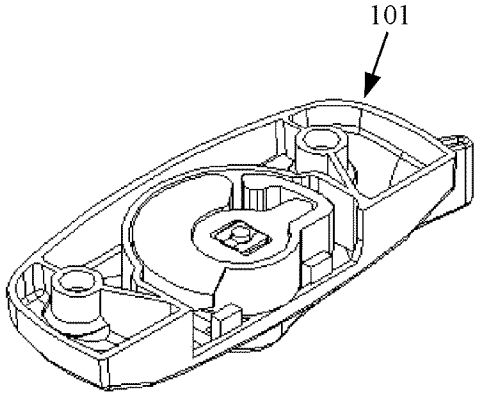
Figure 51:
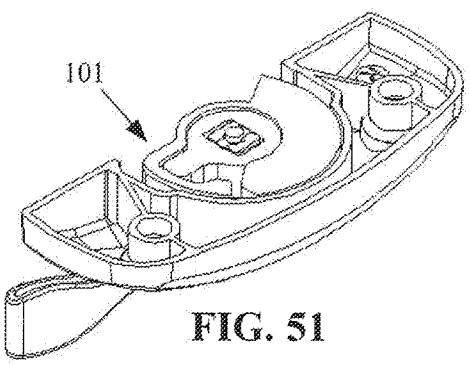
FIG. 51 is a bottom perspective view of the assembled sash lock assembly, shown with the cam in the retracted ("unlock") position.
Figure 54:
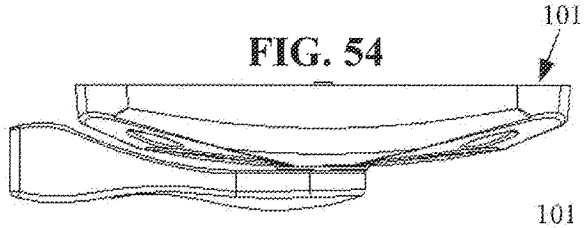
FIG. 54 is a rear view of the sash lock assembly shown in FIG. 52.
Figure 52:
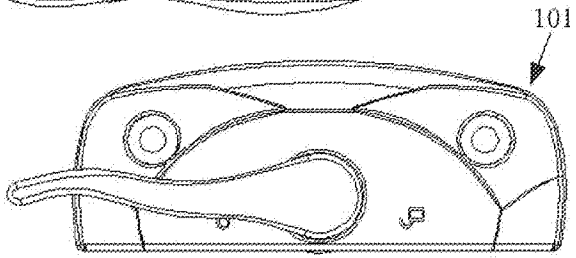
FIG. 52 is a top view of the sash lock assembly, shown with the cam in the retracted ("unlock") position.
Figure 53:
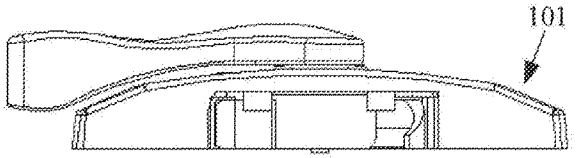
FIG. 53 is a front view of the sash lock assembly shown in FIG. 52.
Figure 50:
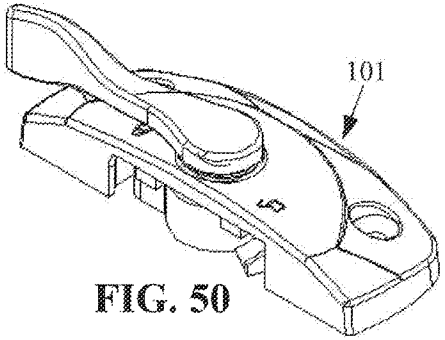
FIG. 50 is a second top perspective view of the assembled sash lock assembly, shown with the cam in the retracted ("unlock") position.
Figure 55:
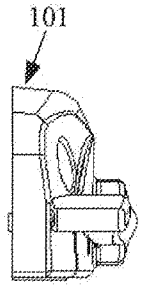
FIG. 55 is an end view of the sash lock assembly shown in FIG. 52.
Figure 49:
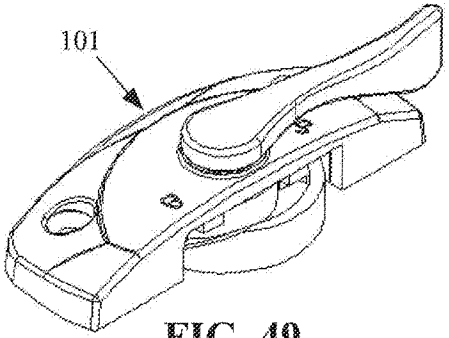
FIG. 49 is a first top perspective view of the assembled sash lock assembly, shown with the cam in the extended ("lock") position.
Figure 56:
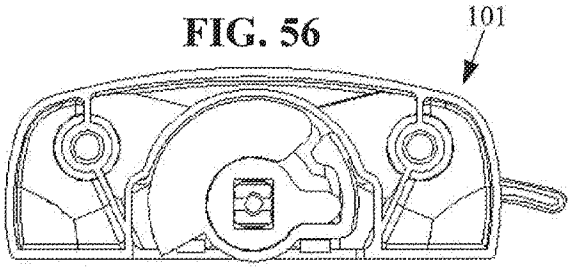
FIG. 56 is a bottom view of the sash lock assembly shown in FIG. 52.
Figure 57:
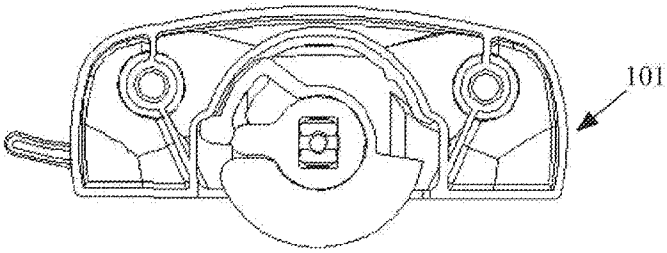
FIG. 57 is the bottom view of FIG. 56, but shown with the cam in the extended ("lock") position.

An assembly sequence for the lock 101 is shown in FIGS. 44-48. Initially, as seen in FIGS. 44 and 45, the cylindrical shaft 143 of the shaft/handle member 140 may be pivotally received into the cylindrical hole 120 of the housing 110. Next, as seen in FIGS. 45 and 46, the locking cam 160 may be received in the cavity of the housing 110 and the cylindrical hole 164 of the cam may be pivotally mounted onto the cylindrical shaft 143 of the shaft/handle member 140. Then, as seen in FIGS. 46-47, the lever arm 180 may be mounted and secured to the shaft/handle member 140. To produce the lock 101 shown in FIG. 48, as well as in FIGS. 49-57.

Figure 79:
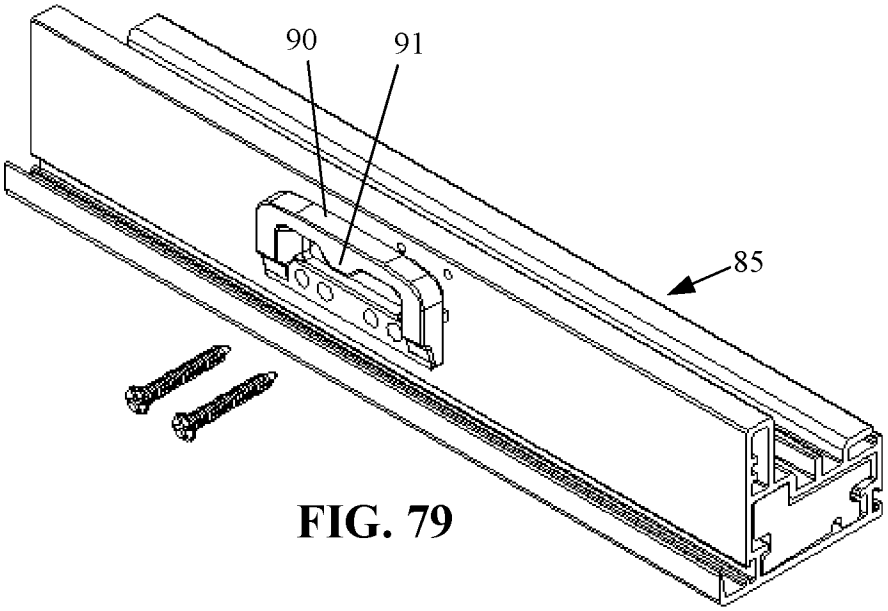
FIG. 79 is an exploded view showing a keeper and mounting screws prior to be mounted to the meeting rail of an upper sash window (or master window frame)
Figure 78:
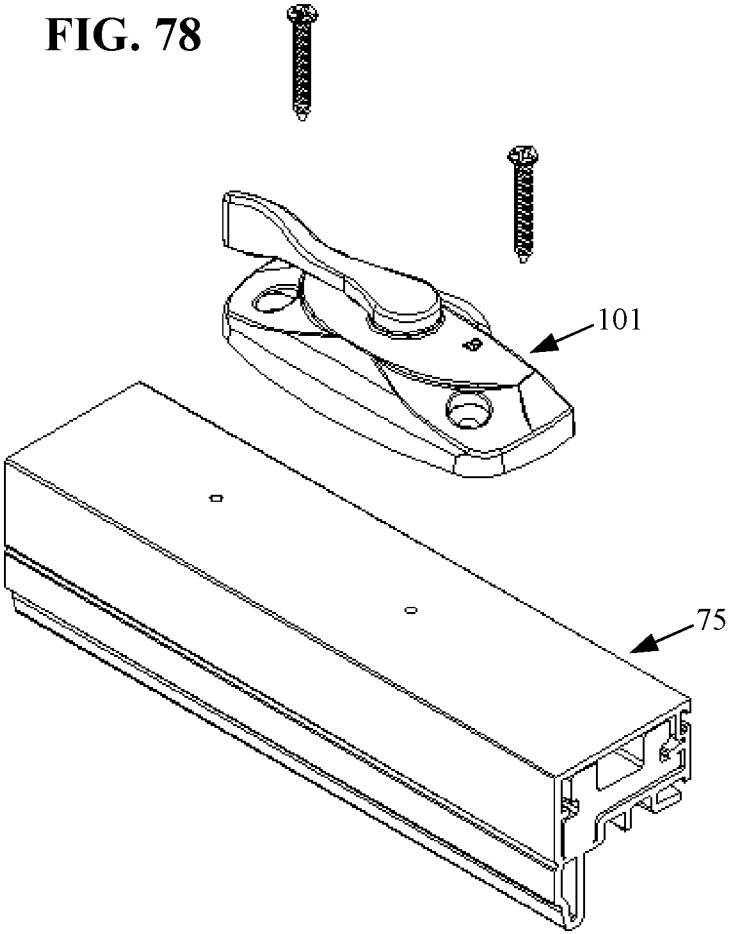
FIG. 78 is an exploded view of the sash lock assembly and mounting screws, shown prior to being mounted to a meeting rail of a lower sash window.
Figure 80:
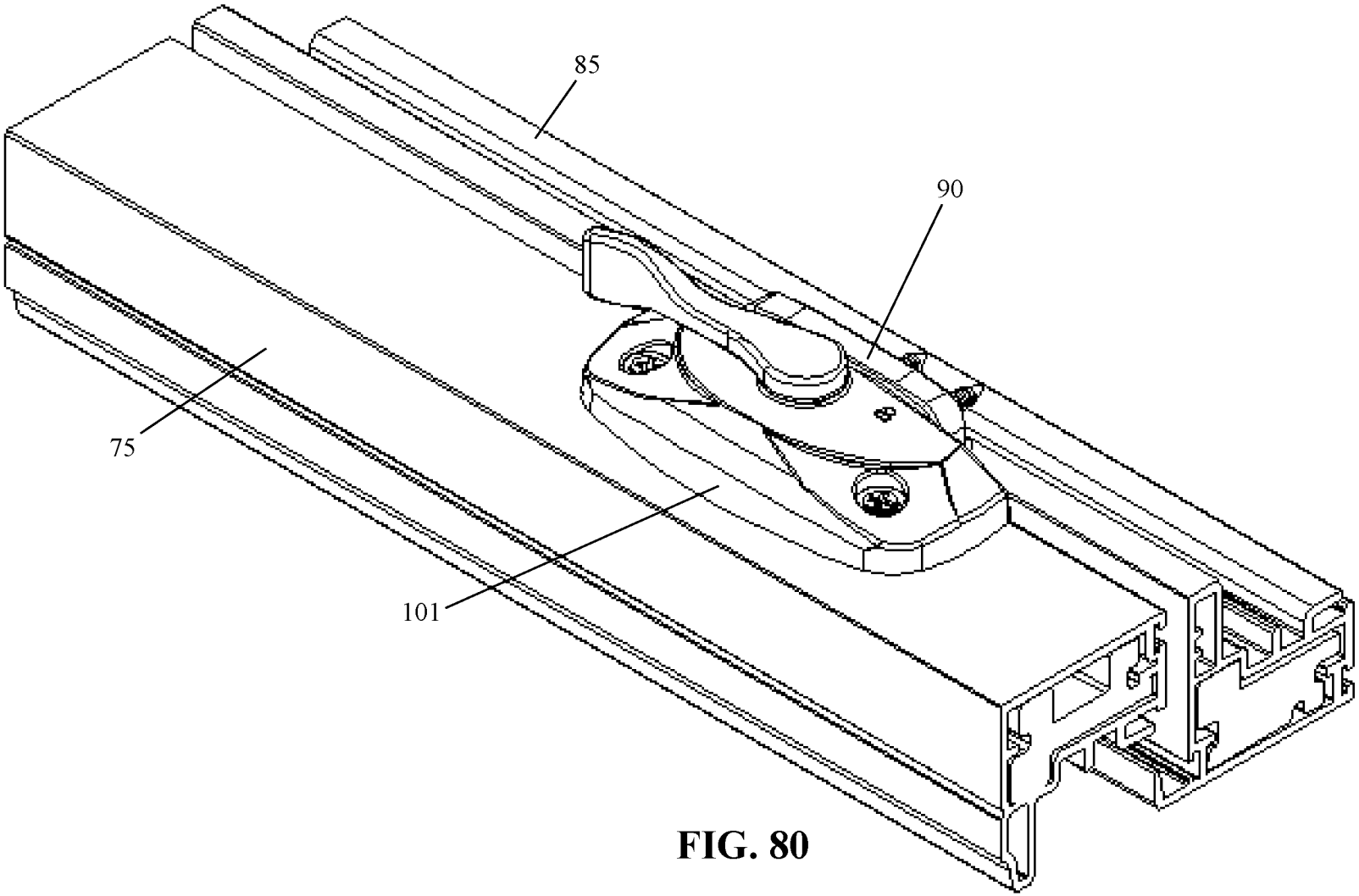
FIG. 80 is a perspective view showing the sash lock assembly after being mounted to the meeting rail of the lower sash window.

Mounting of the lock 101 to a meeting rail of a lower sash window 75 is shown in FIG. 78, and mounting of a corresponding keeper 90 to the master window frame (or to the meeting rail of an upper sash window) 85 is shown in FIG. 79.

Operation of the lock 101 may be seen within FIGS. 58 to 77.

Figure 58:
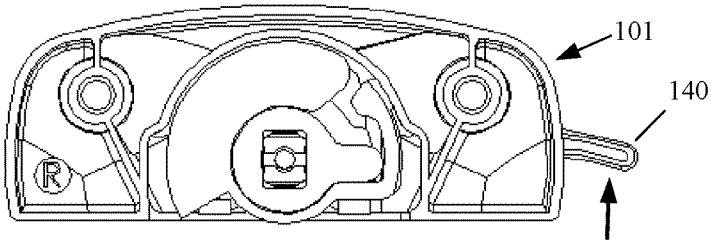

FIG. 58 is a bottom view of the sash lock assembly 101, shown with the shaft/handle member 140 in the zero degree position and with the cam 160 in the unlocked (retracted) position, and with a user just beginning to apply a force to the shaft/handle member, as shown therein by the arrow directed toward the handle portion of the shaft/handle member.

Figure 59:
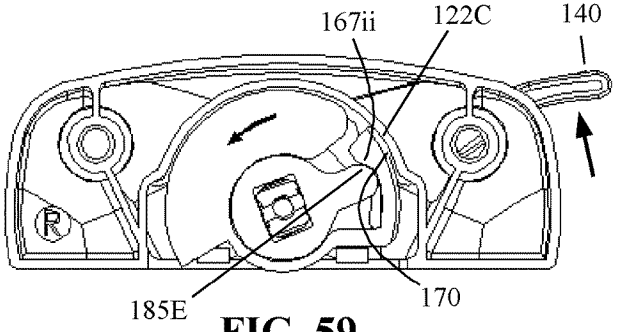

FIG. 59 shows the sash lock assembly 101 of FIG. 58 but after the force applied to the shaft/handle member 140 by the user has caused it to rotate in a first direction sufficiently for the contact surface 185C of the lever member 180 to just contact the engagement surface 1670 of the cam 160, without yet driving the cam to co-rotate. The section views in FIGS. 63-64 correspond to the positions of the lock assembly 101 shown in FIGS. 58-59, and show the protrusion 172 on the cantilevered arm 169 of the cam 160 being adjacent to, but not yet moved with respect to the sloped protrusion 125 on the housing. Note that the lock surface 170 of the cantilevered arm 169 of the cam 160 may be biased into contact with the curved surface 122C of the curved wall portion 122 of the housing 110.

Figure 60:
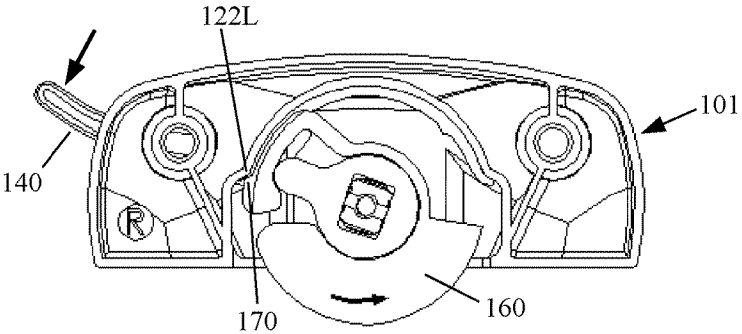
Figure 81:
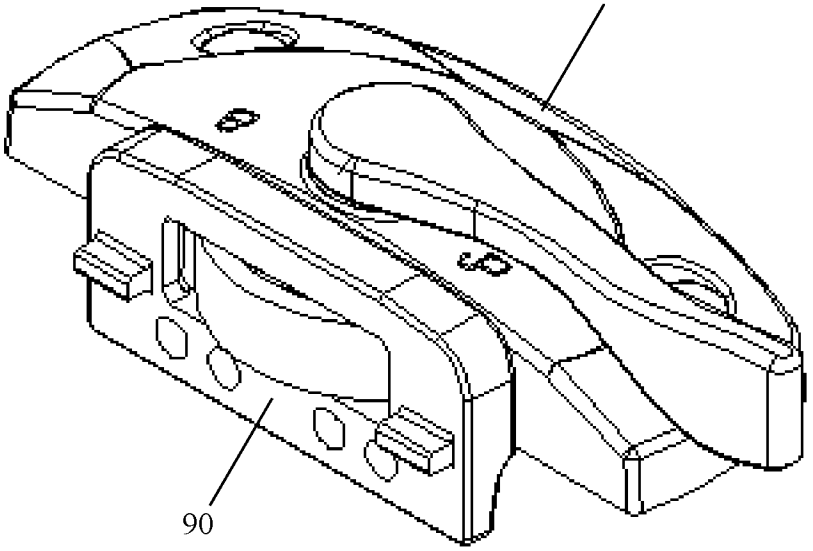
FIG. 81 is a top perspective view showing the cam of the sash lock assembly in an extended ("lock") position, and engaged with the keeper.
Figure 82:
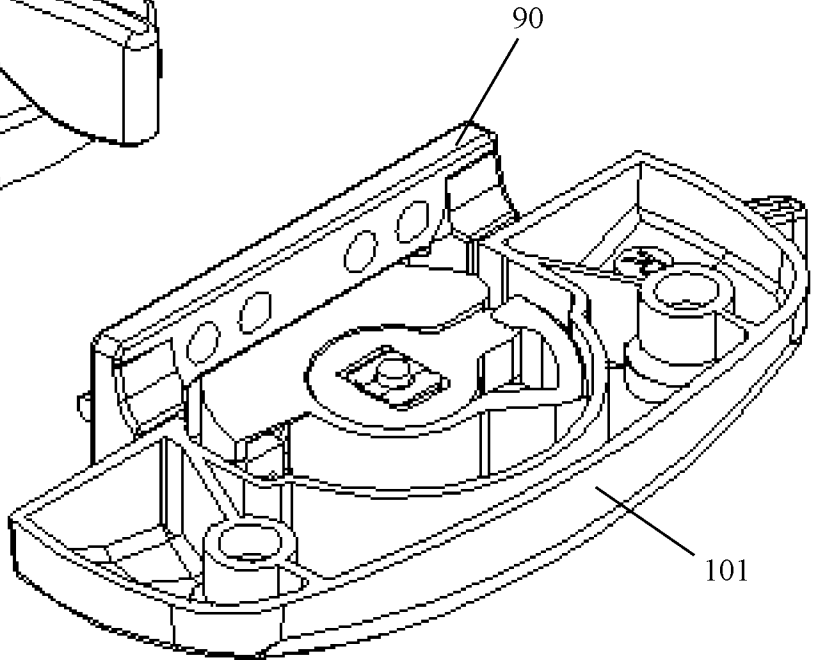
FIG. 82 is a bottom perspective view showing the cam of the sash lock assembly in the extended ("lock") position, and engaged with the keeper.
Figure 87:
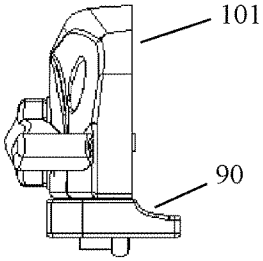
FIG. 87 is a first end view of the sash lock assembly shown in FIG. 73.
Figure 84:
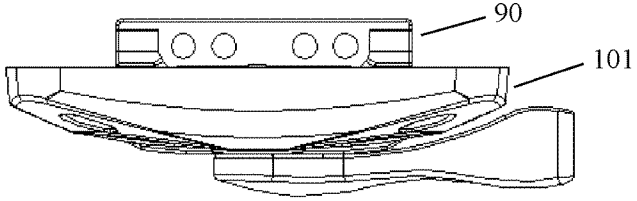
FIG. 84 is a rear view of the sash lock assembly shown in FIG. 73.
Figure 83:
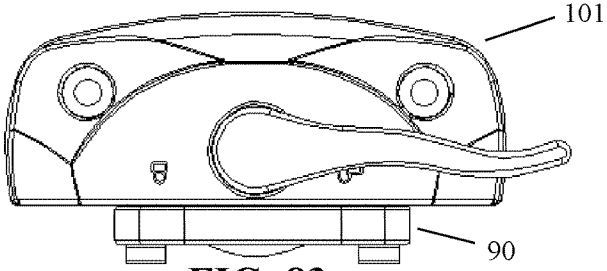
FIG. 83 is a top view of the sash lock assembly and keeper, as shown in FIGS. 71-72.
Figure 85:
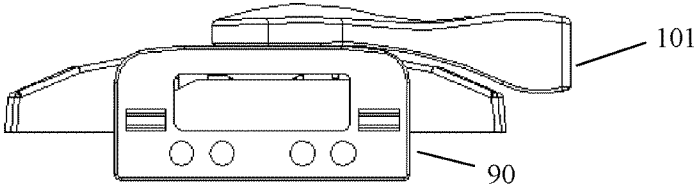
FIG. 85 is a front view of the sash lock assembly shown in FIG. 73.
Figure 86:
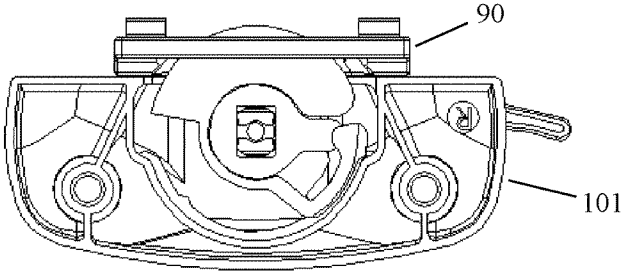
FIG. 86 is a bottom view of the sash lock assembly shown in FIG. 73.
Figure 88:
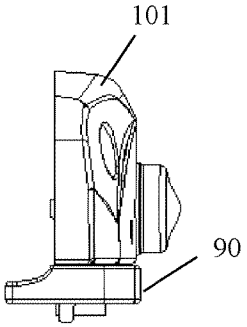
FIG. 88 is a second end view of the sash lock assembly shown in FIG. 73.

FIG. 60 shows the sash lock assembly 101 of FIG. 59 but after the force applied to the shaft/handle member 140 by the user has caused it to rotate for the lever member 180 to drive the cam 160 to co-rotate until the lock surface 170 of the cantilevered arm 169 of the cam reaches, and has been biased to engage, the lock surface 122L of the housing, at which position a portion of the cam protrudes out of the housing 110 in an extended position to engage the key of the keeper on the master window frame (see e.g., FIG. 81-82). As seen in FIG. 60, the lock surface 170 of the cantilevered arm 169 of the cam may engage the lock surface 122L of the housing by being adjacent to it, but with a slight gap therebetween. Note that alternatively, the lock surface 170 of the cantilevered arm 169 of the cam may engage the lock surface 122L of the housing by being biased to make contact with the lock surface 122L on the housing. Further rotational movement of the cam may be limited by a stop. It is also noted that each of the lock surface 122L of the housing 110 and the lock surface 170 of the cantilevered arm 169 of the cam may be a curved surface in one embodiment, and may be a substantially flat surface in another embodiment, and may be a combination of such surfaces in yet another embodiment.

Figure 61:
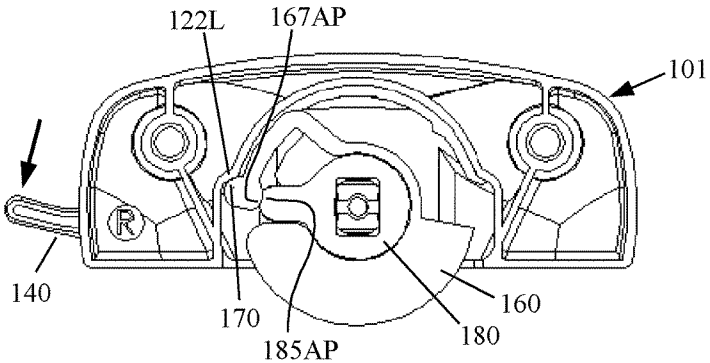

FIG. 61 shows the lock assembly 101 of FIG. 60 but after the shaft/handle member 140 has been rotated a little further for the lever member 180 to co-rotate to cause the apex 185AP of the engagement surface 18SE of the lever member to be driven into proximity to (e.g., to directly abut) the apex 167AP of the engagement surface 167*ii* of the cantilevered arm 169 of the cam 160, thereby causing the distal end of the cantilevered arm to deform, causing the lock surface 170 of the cantilevered arm of the cam into contact with the lock surface 122L on the housing.

Figure 62:
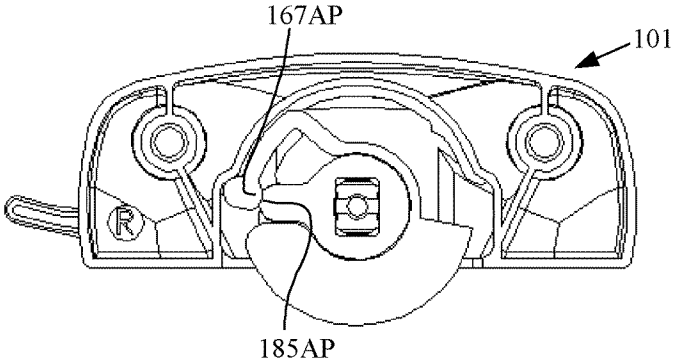

FIG. 62 shows the lock assembly 101 of FIG. 61 but after the shaft/handle member 140 has been rotated a small amount further (being roughly a total of 180 degrees of rotation from the original handle position in FIG. 58), for the lever member to co-rotate to cause the apex 185AP of the engagement surface 185E of the lever member 180 to just cross over the apex 167AP of the engagement surface 167*ii* of the cantilevered arm 169 of the cam 160, for over-center securement of the cam by the lever member. In this position, any attempt to apply a force to the cam 160 from outside of the sash window, to force the cam to counter-rotate is at least in part reacted by the contact of the lock surface 170 of the cantilevered arm of the cam with the lock surface 122L on the housing.

FIGS. 68-72 are a sequence of bottom views of the lock assembly 101 showing the shaft/handle member at various degrees of counter-rotation, as a result of a user applying a force in the opposite direction to the shaft/handle member, as shown by the arrows therein.

Figure 68:
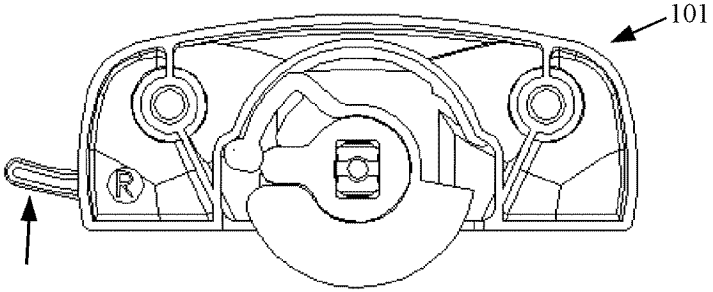
FIG. 68 is the bottom view of the sash lock assembly shown in FIG. 62 with the shaft/handle member in the 180 degree position and the cam in the locked (extended) position, and with the user beginning to apply a force to the shaft/handle member to cause it to counter-rotate.

FIG. 68 is the bottom view of the lock assembly 101 shown in FIG. 62 with the shaft/handle member 140 in roughly the 180 degree position and the cam 160 in the locked (extended) position, and with the user beginning to apply a force to the shaft/handle member to cause it to counter-rotate.

Figure 69:
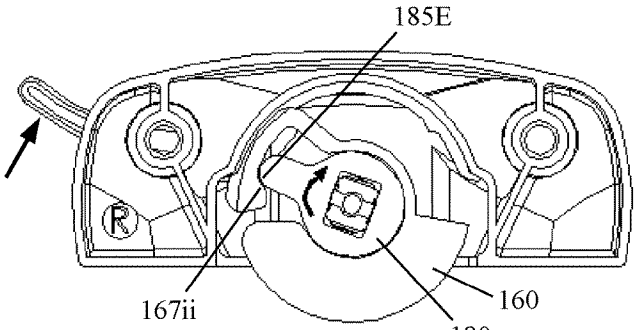
FIG. 69 shows the sash lock assembly of FIG. 68, but after the shaft/handle member has been counter-rotated so that the lever member no longer drives the engagement and contact between the lock surface of the cantilevered arm of the cam and the lock surface of the housing.

FIG. 69 shows the lock assembly 101 of FIG. 68, but after the shaft/handle member 140 has been counter-rotated for the lever member to counter-rotate, so that the engagement surface 185E of the lever member 180 has just counter-rotated back past (or is directed adjacent to) the engagement surface 167*ii* of the cantilevered arm 169 of the cam 160. Being so counter-rotated, the distal end of the cantilevered arm is no longer deformed, and therefore the lock surface 170 of the cantilevered arm of the cam is no longer deformed into contact with the lock surface 122L on the housing.

Figure 70:
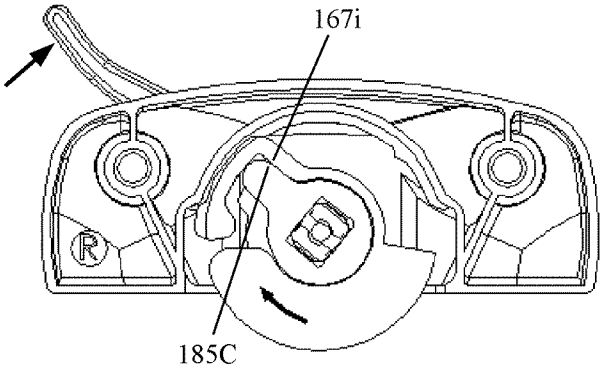
FIG. 70 shows the sash lock assembly of FIG. 69, but after the shaft/handle member has been counter-rotated sufficiently for the lever member to just contact a second end of the recess in the cam, without yet driving it to co-rotate.

FIG. 70 shows the lock assembly 101 of FIG. 69, but after the shaft/handle member 140 has been counter-rotated further for the contact surface 185C of the lever member 180 to just contact the contact surface 167*i* of the cam 160, without yet driving the cam to co-rotate.

Figure 71:
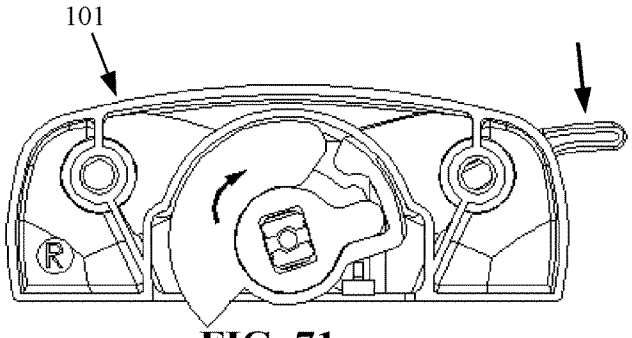
FIG. 71 shows the sash lock assembly of FIG. 70, but after the shaft/handle member has been counter-rotated further for the lever member to drive the cam to cause the arm to be almost completely retracted into the housing, and for a protrusion on the cantilevered arm of the cam to just contact a protrusion on the housing.
Figure 76:
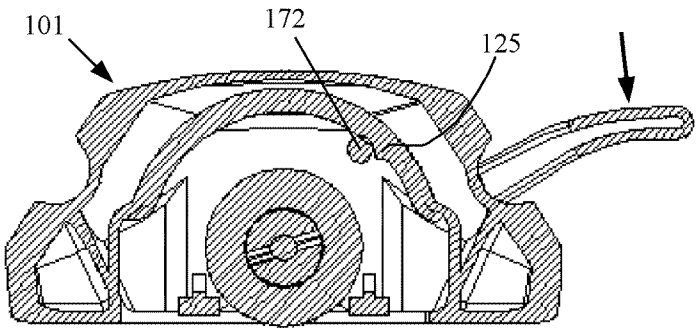

FIG. 71 shows the lock assembly 101 of FIG. 70, but after the shaft/handle member 140 has been counter-rotated further for the lever member 180 to drive the cam to be disengaged from the keeper and be almost completely retracted into the housing, and for a protrusion on the cantilevered arm of the cam to just contact a protrusion on the housing (see FIG. 76).

Figure 72:
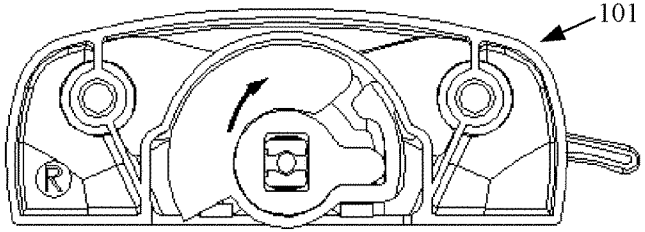
FIG. 72 shows the sash lock assembly of FIG. 71, but after the shaft/handle member has been counter-rotated a small amount further for cam to be completely retracted within the housing, and for the protrusion on the cantilevered arm of the cam to just cross over the protrusion on the housing, which may act as a detent and may provide a tactile indication to the user of the shaft/handle member being positioned in the retracted (unlocked) position.
Figure 74:
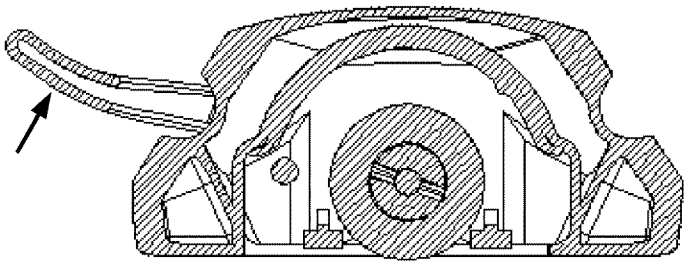
FIGS. 73-77 show a section cut through the sash lock for each of the shaft/handle member and lever arm and cam positions illustrated in FIGS. 68-72, showing the position of a cylindrical protrusion of the cantilevered member of the cam with respect to the corresponding protrusion on the housing, at each shaft/handle member position.
Figure 73:
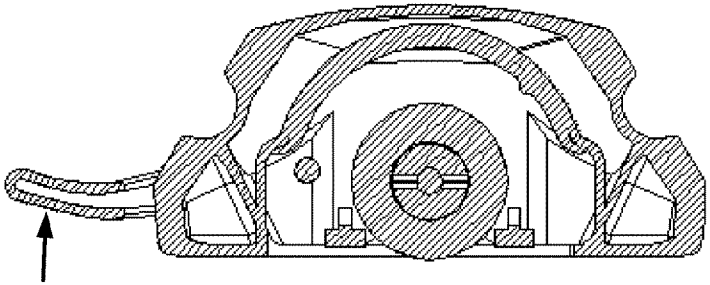
Figure 75:
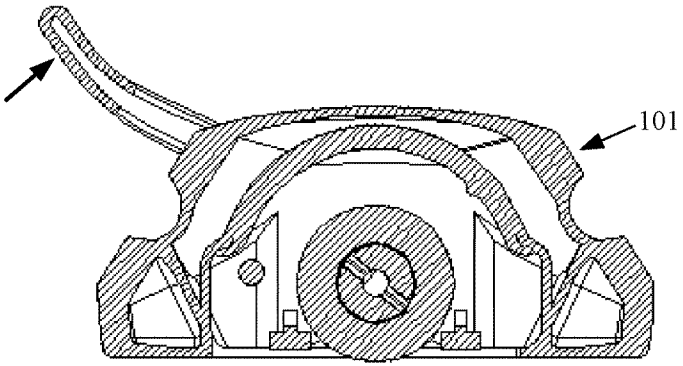

FIG. 72 shows the lock assembly 101 of FIG. 71, but after the shaft/handle member 140 has been counter-rotated a small amount further for cam to be completely retracted within the housing, and for the protrusion on the cantilevered arm of the cam to just cross over the protrusion on the housing (see FIG. 77), which may act as a detent and may provide a tactile indication to the user of the shaft/handle member being positioned in the retracted (unlocked) position.

While illustrative implementations of one or more embodiments of the disclosed apparatus are provided hereinabove, those skilled in the art and having the benefit of the present disclosure will appreciate that further embodiments may be implemented with various changes within the scope of the disclosed apparatus. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A tamper-resistant lock for a sash window comprising:

a housing, said housing comprising:

a wall shaped to form an exterior surface, and an interior surface that defines a cavity;

a substantially cylindrical hole in said wall;

wherein a portion of said interior surface of said wall comprises a curved surface being curved about said substantially cylindrical hole; and wherein a distal end of said curved surface transitions into a lock surface;

a substantially cylindrical shaft rotatably mounted in said substantially cylindrical hole;

a cam, said cam comprising: a hub with a substantially cylindrical hole to rotatably mount said cam to said substantially cylindrical shaft; and a cantilevered arm, said cantilevered arm configured to cantilever away from said hub, a distal end of said cantilevered arm comprising a lock surface, an engagement surface, and an apex between said engagement surface and said lock surface;

a lever member on said shaft, said lever member configured to rotate when said shaft is rotated, said lever member having an engagement surface;

wherein when said shaft is actuated in a first rotational direction from an unlock position, said lever member co-rotates with said shaft independent of said cam;

wherein upon continued rotation of said shaft in said first rotational direction, said engagement surface of said lever member contacts said engagement surface of said cantilevered arm, and drives said cam to co-rotate in said first rotational direction into a cam lock position;

wherein upon continued rotation of said shaft in said first rotational direction, said lever member again rotates independent of said cam, and an apex of said engagement surface of said lever member rotates past said apex of said engagement surface of said cantilevered arm, causing a distal end of said cantilevered arm of said cam to elastically deform to position said lock surface of said cantilevered arm in contact with said lock surface of said housing, and provide over-center securement of said cantilevered arm with respect to said housing, at a tamper resistant position.

2. The tamper-resistant lock according to claim 1, wherein said engagement surface of said cantilevered arm of said cam is biased toward said curved surface of said wall when said cam is rotatably mounted to said substantially cylindrical shaft.

3. The tamper-resistant lock according to claim 2, wherein said lock surface of said cantilevered arm is biased into contact with said lock surface of said housing when said cantilevered arm of said cam reaches said tamper resistant position.

4. The tamper-resistant lock according to claim 3, wherein said cantilevered arm comprises a first portion that transitions into a second portion, wherein said first portion cantilevers away from said hub, and wherein said second portion comprises an arcuate shape, with said lock surface and said engagement surface of said cantilevered arm positioned on said arcuate shape.

5. The tamper-resistant lock according to claim 4, wherein said curved interior surface of said wall of said housing comprises an arcuate surface formed substantially concentric with said substantially cylindrical hole.

6. The tamper-resistant lock according to claim 3, wherein said lock surface of said housing comprises a curved surface; and wherein said lock surface of said cantilevered arm comprises a curved surface.

7. The tamper-resistant lock according to claim 3, said lock surface of said housing comprises a substantially flat surface; and wherein said lock surface of said cantilevered arm comprises a substantially flat surface.

8. The tamper-resistant lock according to claim 1, wherein said cam comprises a recess having a contact surface;

wherein said lever member comprises a contact surface; and wherein said contact surface of said lever member contacts said contact surface of said cam to drive said cam in a second rotational direction when said shaft is actuated in the second rotational direction; and wherein upon rotation of said shaft in the second rotational direction, said contact surface of said lever member contacts said contact surface of said cam and drives said cam in the second rotational direction to cause said lock surface of said cantilevered arm to disengage from said lock surface of said housing, and drive said cam into said unlock position.

9. The tamper-resistant lock according to claim 1, wherein said shaft is formed with a handle portion, with said handle portion formed to be substantially perpendicular to an axis of said shaft.

10. The tamper-resistant lock according to claim 1, wherein said cantilevered arm of said cam comprises a protrusion;

wherein said curved surface of said wall of said housing comprises a sloped protrusion; and wherein when said shaft is rotated in the second rotational direction to drive said cam into said unlock position, said protrusion on said cantilevered arm of said cam crosses said sloped protrusion on said curved surface of said wall of said housing, to provide a tactile indication of said tamper-resistant lock being placed in said unlock position.

11. A tamper-resistant lock for a sash window comprising:

a housing, said housing comprising:

a wall shaped to form an exterior surface, and an interior surface that defines a cavity;

a substantially cylindrical hole in said wall;

wherein a portion of said interior surface of said wall comprises a curved surface being curved about said substantially cylindrical hole; and wherein a distal end of said curved surface transitions into a lock surface;

a substantially cylindrical shaft rotatably mounted in said substantially cylindrical hole;

a cam, said cam comprising: a hub with a substantially cylindrical hole to rotatably mount said cam to said substantially cylindrical shaft; a recess having a contact surface; and a cantilevered arm, a distal end of said cantilevered arm comprising a lock surface and an engagement surface;

a lever member on said shaft, said lever member having an engagement surface and a contact surface, wherein said engagement surface of said lever member contacts said engagement surface of said cantilevered arm to drive said cam in a first rotational direction when said shaft is actuated in the first rotational direction;

wherein said contact surface of said lever member contacts said contact surface of said cam to drive said cam in a second rotational direction when said shaft is actuated in the second rotational direction; and wherein upon rotation of said shaft in the first rotational direction from an unlock position, said lever member drives said cam into a lock position whereat said lock surface of said cantilevered arm engages said lock surface of said housing;

wherein said engagement surface of said lever member comprises an apex;

wherein said engagement surface of said cantilevered arm comprises an apex;

wherein when said cam is rotated in the first rotational direction into said lock position, said apex of said engagement surface of said lever member is rotated to at least substantially abut said apex of said engagement surface of said cantilevered arm;

wherein when said cam is rotated in the first rotational direction into said lock position, said apex of said engagement surface of said lever member is rotated past said apex of said engagement surface of said cantilevered arm for over-center securement of said cantilevered arm; and wherein said apex of said engagement surface of said lever member being rotated past said apex of said engagement surface of said cantilevered arm causes said distal end of said cantilevered arm to elastically deform said lock surface of said cantilevered arm into contact with said lock surface of said housing.

12. The tamper-resistant lock according to claim 11, wherein said cantilevered arm comprises a first portion that transitions into a second portion, wherein said first portion cantilevers away from said hub, and wherein said second portion comprises an arcuate shape, with said lock surface and said engagement surface of said cantilevered arm positioned on said arcuate shape.

13. The tamper-resistant lock according to claim 12, wherein said curved interior surface of said wall of said housing comprises an arcuate surface formed substantially concentric with said substantially cylindrical hole.

14. A tamper-resistant lock for a sash window comprising:

a housing, said housing comprising:

a wall shaped to form an exterior surface, and an interior surface that defines a cavity;

a substantially cylindrical hole in said wall;

wherein a portion of said interior surface of said wall comprises a curved surface being curved about said substantially cylindrical hole; and wherein a distal end of said curved surface transitions into a lock surface;

a substantially cylindrical shaft rotatably mounted in said substantially cylindrical hole;

a cam, said cam comprising: a hub with a substantially cylindrical hole to rotatably mount said cam to said substantially cylindrical shaft; a recess having a contact surface; and a cantilevered arm, a distal end of said cantilevered arm comprising a lock surface and an engagement surface;

a lever member on said shaft, said lever member having an engagement surface and a contact surface, wherein said engagement surface of said lever member contacts said engagement surface of said cantilevered arm to drive said cam in a first rotational direction when said shaft is actuated in the first rotational direction;

wherein said contact surface of said lever member contacts said contact surface of said cam to drive said cam in a second rotational direction when said shaft is actuated in the second rotational direction; and wherein upon rotation of said shaft in the first rotational direction from an unlock position, said lever member drives said cam into a lock position whereat said lock surface of said cantilevered arm engages said lock surface of said housing;

wherein said engagement surface of said lever member comprises an apex;

wherein said engagement surface of said cantilevered arm comprises an apex;

wherein when said cam is rotated in the first rotational direction into said lock position, said apex of said engagement surface of said lever member is rotated to at least substantially abut said apex of said engagement surface of said cantilevered arm;

wherein when said cam is rotated in the first rotational direction into said lock position, said apex of said engagement surface of said lever member is rotated past said apex of said engagement surface of said cantilevered arm for over-center securement of said cantilevered arm;

wherein upon rotation of said shaft in the second rotational direction, said lever member drives said cam in the second rotational direction to cause said lock surface of said cantilevered arm to disengage from said lock surface of said housing, and drive said cam into said unlock position; and wherein said contact surface of said cam and said engagement surface of said cam are spaced apart for a first portion of the rotation of said shaft in each of the first and second rotational directions being without said cam being driven by said lever member, and for a second portion of the rotation of said shaft in each of the first and second rotational directions to thereafter cause said lever member to drive said cam.

15. The tamper-resistant lock according to claim 14, wherein said shaft is formed with a handle portion, with said handle portion formed to be substantially perpendicular to an axis of said shaft.

16. The tamper-resistant lock according to claim 15, wherein said cantilevered arm of said cam comprises a protrusion;

wherein said curved surface of said wall of said housing comprises a sloped protrusion; and wherein when said shaft is rotated in the second rotational direction to drive said cam into said unlock position, said protrusion on said cantilevered arm of said cam crosses said sloped protrusion on said curved surface of said wall of said housing, to provide a tactile indication of said tamper-resistant lock being placed in said unlock position.

* * * * *